US007592975B2

(12) United States Patent
Yamazaki et al.

(10) Patent No.: US 7,592,975 B2
(45) Date of Patent: Sep. 22, 2009

(54) DISPLAY DEVICE AND DRIVING METHOD THEREOF

(75) Inventors: Shunpei Yamazaki, Tokyo (JP); Mitsuaki Osame, Kanagawa (JP); Jun Koyama, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 609 days.

(21) Appl. No.: 11/208,278

(22) Filed: Aug. 18, 2005

(65) Prior Publication Data

US 2006/0044229 A1 Mar. 2, 2006

(30) Foreign Application Priority Data

Aug. 27, 2004 (JP) ..... 2004-247735

(51) Int. Cl.
*G09G 3/28* (2006.01)

(52) U.S. Cl. ..... 345/60; 345/64; 345/67

(58) Field of Classification Search ..... 257/E27.127, 257/E27.132; 345/60, 55, 64, 67, 76, 77, 345/82, 84, 90–92, 214
See application file for complete search history.

(56) References Cited

U.S. PATENT DOCUMENTS 4,451,970 A * 6/1984 Izu et al. ..... 438/12
4,523,189 A 6/1985 Takahara et al. ..... 345/781
4,806,496 A 2/1989 Suzuki et al. ..... 437/4
5,027,040 A 6/1991 Ikeda et al.
5,446,445 A 8/1995 Bloomfield et al.
5,477,858 A 12/1995 Norris et al.
5,552,678 A * 9/1996 Tang et al. ..... 315/169.3
5,955,765 A 9/1999 Yamazaki et al. ..... 257/365
6,278,242 B1 * 8/2001 Cok et al. ..... 315/169.1
6,380,689 B1 * 4/2002 Okuda ..... 315/169.3

(Continued)

FOREIGN PATENT DOCUMENTS

EP 1 094 438 4/2001

(Continued)

OTHER PUBLICATIONS

Zou, D. et al, "Improvement of Current-Voltage Characteristics in Organic Light Emitting Diodes by Application of Reversed-Bias Voltage," Japanese Journal of Applied Physics, vol. 37, part 2, No. 11B, pp. L-1406-L-1408, Nov. 15, 1998.

(Continued)

*Primary Examiner*—Amare Mengistu
*Assistant Examiner*—Koosha Sharifi
(74) *Attorney, Agent, or Firm*—Cook Alex Ltd.

(57) ABSTRACT

A display device where a reverse driving voltage can be applied to a light-emitting element at regular intervals in order to insulate a short-circuit portion, thereby prolonging the life of the light-emitting element. A short-circuit portion is burnt out by providing a period for supplying a forward voltage or current to a light-emitting element, and a period for supplying a reverse voltage or current thereto. AC drive is performed only before mounting an AC driver circuit on an electronic appliance, and it is not performed after the mounting. Accordingly, the number of components in an electronic appliance can be reduced as well as the cost reduction of the components can be achieved.

22 Claims, 20 Drawing Sheets

U.S. PATENT DOCUMENTS

| | | | | |
|---|---|---|---|---|
| 6,522,319 | B1 | 2/2003 | Yamazaki | 345/103 |
| 6,600,160 | B2 | 7/2003 | Kobayashi et al. | |
| 6,731,276 | B1 | 5/2004 | Ishizuka | 345/211 |
| 6,750,833 | B2 | 6/2004 | Kasai | 345/76 |
| 6,870,192 | B2 | 3/2005 | Yamazaki et al. | |
| 6,872,973 | B1 | 3/2005 | Koyama et al. | 257/59 |
| 6,909,111 | B2 | 6/2005 | Yamagata et al. | 257/59 |
| 6,975,311 | B2 | 12/2005 | Ide et al. | |
| 7,005,647 | B2 | 2/2006 | Kobayashi et al. | |
| 7,045,369 | B2 | 5/2006 | Yamazaki et al. | |
| 7,170,094 | B2 | 1/2007 | Yamazaki et al. | |
| 7,176,857 | B2 | 3/2007 | Osame et al. | |
| 7,202,842 | B2 | 4/2007 | Kasai et al. | |
| 7,245,297 | B2 | 7/2007 | Kimura et al. | |
| 7,256,758 | B2 | 8/2007 | Hu et al. | |
| 7,268,332 | B2 | 9/2007 | Yamazaki | |
| 7,268,498 | B2 | 9/2007 | Miyagawa et al. | |
| 2002/0042152 | A1 | 4/2002 | Yamazaki et al. | 438/4 |
| 2002/0047839 | A1 | 4/2002 | Kasai | 345/211 |
| 2002/0113760 | A1 | 8/2002 | Kimura | 345/82 |
| 2002/0180671 | A1 | 12/2002 | Inukai | 345/76 |
| 2003/0058210 | A1 | 3/2003 | Yamazaki et al. | 345/89 |
| 2003/0058543 | A1 | 3/2003 | Sheedy et al. | |
| 2003/0076281 | A1 | 4/2003 | Morgan et al. | |
| 2003/0103022 | A1* | 6/2003 | Noguchi et al. | 345/77 |
| 2003/0160745 | A1 | 8/2003 | Osame et al. | 345/82 |
| 2003/0203523 | A1 | 10/2003 | Yamazaki et al. | |
| 2004/0041525 | A1* | 3/2004 | Park et al. | 315/169.3 |
| 2004/0196218 | A1* | 10/2004 | Senda et al. | 345/76 |
| 2005/0063194 | A1 | 3/2005 | Lys et al. | |
| 2005/0134189 | A1 | 6/2005 | Osame et al. | 315/169.1 |
| 2005/0151489 | A1 | 7/2005 | Lys et al. | |
| 2005/0168491 | A1 | 8/2005 | Takahara et al. | |
| 2005/0259093 | A1 | 11/2005 | Osame et al. | |
| 2005/0264472 | A1 | 12/2005 | Rast | |
| 2006/0050032 | A1 | 3/2006 | Gunner et al. | |
| 2006/0054893 | A1 | 3/2006 | Nathan et al. | |
| 2006/0244695 | A1* | 11/2006 | Komiya | 345/76 |
| 2007/0035340 | A1 | 2/2007 | Kimura | |
| 2007/0063935 | A1 | 3/2007 | Yoshida | |
| 2008/0042947 | A1 | 2/2008 | Miyagawa et al. | |

FOREIGN PATENT DOCUMENTS

| | | |
|---|---|---|
| JP | 2001-142413 | 5/2001 |
| JP | 2002-169509 | 6/2002 |
| WO | WO 03003339 A1 * | 1/2003 |

OTHER PUBLICATIONS

U.S. Appl. No. 11/011,881 (pending) to Osame et al, filed Dec. 14, 2004, including specification, claims, abstract, drawings and PTO filing receipt.

* cited by examiner

DISPLAY DEVICE AND DRIVING METHOD THEREOF

BACKGROUND OF THE INVENTION

1. Field of the Invention

The present invention relates to a display device for displaying images by input of video signals, and more particularly to a display device having light-emitting elements. In addition, the invention relates to an electronic appliance using the display device.

2. Description of the Related Art

Description is made below on a display device for displaying images by disposing a light-emitting element in each pixel and controlling the light emission thereof The display device has a display and a peripheral circuit for inputting signals thereto. FIG. 16 shows a configuration of a pixel portion of a display.

In a pixel portion 1603, source signal lines S1 to Sx, gate signal lines G1 to Gy, power source lines V1 to Vx, and pixels having a matrix arrangement of x (x is a natural number) columns and y (y is a natural number) rows are disposed. Each pixel 1700 includes a switching transistor 1701, a driving transistor 1702, a capacitor 1703 and a light-emitting element 1704.

FIG. 17 shows an enlarged view of one pixel in the pixel portion 1603 shown in FIG. 16.

The pixel includes one source signal line S among the source signal lines S1 to Sx, one gate line G among the gate signal lines G1 to Gy, one power source line V among the power source lines V1 to Vx, the switching transistor 1701, the driving transistor 1702, the capacitor 1703 and the light-emitting element 1704.

A gate electrode of the switching transistor 1701 is connected to the gate signal line G, and one of a source electrode and a drain electrode thereof is connected to the source signal line S while the other is connected to a gate electrode of the driving transistor 1702 and to one electrode of the capacitor 1703. One of a source electrode and a drain electrode of the driving transistor 1702 is connected to the power source line V while the other is connected to an anode or a cathode of the light-emitting element 1704. One of the two electrodes of the capacitor 1703 which is not connected to the driving transistor 1702 nor the switching transistor 1701 is connected to the power source line V.

Description is made below on the operation of a pixel having the aforementioned configuration where the light-emitting element 1704 emits light.

Upon input of a signal to the gate signal line G, the switching transistor 1701 is turned on. Through the source electrode and the drain electrode of the switching transistor 1701 which is on, a signal is inputted from the source signal line S to the gate electrode of the driving transistor 1702. The capacitor 1703 holds the potential of the source signal line S. By a signal inputted to the gate electrode of the driving transistor 1702, the driving transistor 1702 is turned on. At this time, a current value flowing between the source electrode and the drain electrode of the driving transistor 1702 is determined by a potential difference between the gate electrode of the driving transistor 1702 and the power source line V. When a current flowing between the source electrode and the drain electrode of the driving transistor 1702 flows into the light-emitting element 1704 through a pixel electrode of the light-emitting element 1704, the light-emitting element 1704 emits light.

At this time, the current value supplied to the light-emitting element 1704 is required to be constant at all times without being affected by the degradation of the light-emitting element 1704. The current value supplied to the light-emitting element 1704 is set constant independently of the potential difference between the source electrode and the drain electrode of the driving transistor 1702; therefore, the driving transistor 1702 is desirably designed to operate in the saturation region.

In this manner, in a conventional display, a forward driving voltage is applied to a light-emitting element.

However, it has been found that the degradation of the I-V characteristics of a light-emitting element can be improved by applying a reverse driving voltage to a light-emitting element at regular intervals (see Non-patent Document 1).

[Non-patent Document 1]

D. Zou et al., "Improvement of Current-Voltage Characteristics in Organic Light Emitting Diodes by Application of Reversed-Bias Voltage", Jpn. J. Appl. Phys. Vol. 37 (1998), pp. L1406-L1408, Part 2, No. 11B, 15 Nov. 1998

There is an initial defect that a pixel electrode and a counter electrode are short-circuited, which produces a non-light-emitting region in the pixel. The short circuit may be caused due to the adhesion of foreign substances; pinholes in a thin electroluminescent layer which are produced by minute projections of an anode during the formation thereof; or pinholes which are produced due to the uneven deposition of a thin electroluminescent layer. In a pixel where such an initial defect occurs, light emission/non-light emission in accordance with signals is not performed and favorable image display cannot be performed because the whole elements cannot emit light with almost all currents flown to the short-circuit portion, or only specific pixels emit light or no light.

Not only such an initial defect, but another defect called a progressive defect may occur where the anode and the cathode are short-circuited with time. The short circuit between the anode and the cathode which is caused with time occurs due to the minute projections produced in the formation of the anode. That is, a stack having a pair of electrodes and an electroluminescent layer interposed therebetween has a potential short-circuit portion, which becomes dominant with time. It is said that in addition to the short circuit between the anode and the cathode, the progressive defect may be caused by a loose contact between the electroluminescent layer and the cathode which is caused by a slight gap between the electroluminescent layer and the cathode expanding with time.

The progress of the aforementioned initial defect can be suppressed by applying a reverse driving voltage to the light-emitting element to carbonize or oxidize the short-circuit portion to be insulated. In addition, the generation and progress of the aforementioned progressive defect can be suppressed by applying a reverse driving voltage to the light-emitting element to insulate the short-circuit portion by carbonization or oxidization, or by suppressing the expansion of the gap between the electroluminescent layer and the cathode.

However, in order to insulate the short-circuit portion, a sufficiently large current is required to be flown to insulate the short-circuit portion. Generally, a current which is sufficiently large to insulate the short-circuit portion has a far larger value than a forward current which is flown to the light-emitting element to emit light. In the pixel configurations in FIGS. 16 and 17, the current value supplied to the light-emitting element 1704 is controlled by the driving transistor 1702 in either case of the forward direction or the reverse direction. Provided that the current value flowing between the source electrode and the drain electrode, when the driving transistor 1702 is operated in the saturation region, is designed to be a forward current flowing to the light-emitting element 1704, the driving transistor 1702 cannot supply a sufficiently large current for insulating the short-circuit portion when a reverse driving voltage is applied to the light-emitting element.

SUMMARY OF THE INVENTION

Therefore, it is a primary object of the invention to provide a display device where a reverse driving voltage can be applied to a light-emitting element at regular intervals in order to insulate a short-circuit portion to prolong the life of the light-emitting element.

It is another object of the invention to provide a display device where the reduction of component areas after packaging and the cost reduction of the components are achieved.

In the display device of the invention, an initial defect of a light-emitting element is burnt out by performing AC drive as an initial aging step after completing a sealing step of the light-emitting element. After that, a power source circuit and a peripheral circuit thereof are mounted. At this time, as the AC drive has already been performed, a power source circuit and a peripheral circuit thereof for performing AC drive are not required to be mounted. Thus, the reduction of component areas and the cost reduction of the components are achieved.

In the display device of the invention, a path for supplying a reverse current to a light-emitting element is provided in addition to a path for supplying a forward current to the light-emitting element. The path for supplying a forward current to the light-emitting element is provided with a driving TFT while the path for supplying a reverse current to the light-emitting element is provided with an additional transistor (AC transistor). With the two transistors, the current supply paths are switched. As the AC transistor, a transistor having a lower L/W (ratio of the channel length L to the channel width W) than the driving TFT is employed. According to such a structure, a current flowing to the light-emitting element can be supplied to the AC transistor when a reverse driving voltage is applied to the light-emitting element. In addition, the AC transistor can be controlled so as not to operate after being mounted on an electronic appliance. This is because no circuit for operating the AC transistor is mounted after mounting the AC transistor on an electronic appliance. That is, no circuit for operating the AC transistor is provided, thereby the reduction of component areas and the cost reduction of the components can be achieved.

Specifically, in the invention, L/W (ratio of the channel length L to the channel width W) of the driving transistor is set to be higher than the L/W of the AC transistor, and the driving transistor is operated in the saturation region while the AC transistor is operated in the linear region. Specifically, L of the driving transistor is set to be longer than W thereof, and more desirably, when L/W is set to be X/1, X is set to be 5 or larger. As for the AC transistor, L is set to be equal or shorter than W thereof. Accordingly, a reverse current flowing to a light-emitting element in a pixel when with a reverse driving voltage being applied thereto can have a larger value than a forward current flowing to the light-emitting element with a forward driving voltage being applied thereto.

A display device of the invention includes a light-emitting element, a first path for supplying a forward current to the light-emitting element, a second path for supplying a reverse current to the light-emitting element, a driving transistor disposed in the first path, and an AC transistor disposed in the second path. By using the driving transistor and the AC transistor, the first path and the second path are switched. The AC transistor is not operated after it is mounted on an electronic appliance.

A display device of the invention includes pixels each having a light-emitting element, a driving transistor for controlling the amount of a forward current flowing to the light-emitting element, a switching transistor for controlling input of a video signal, and an AC transistor for controlling a reverse current flowing to the light-emitting element. The AC transistor is not operated after it is mounted on an electronic appliance. This is because no circuit for operating the AC transistor is provided after mounting the AC transistor on an electronic appliance, thereby the reduction of component areas and the cost reduction of the components can be achieved.

A display device of the invention includes pixels each having a light-emitting element, a driving transistor for controlling the amount of a forward current flowing to the light-emitting element, a switching transistor for controlling input of a video signal, and an AC transistor for controlling a reverse current flowing to the light-emitting element. The light-emitting element includes a pixel electrode and a counter electrode. A gate electrode of the switching transistor is connected to a gate signal line, and one of a source electrode and a drain electrode of the switching transistor is connected to a source signal line through which the video signal flows while the other is connected to a gate electrode of the driving transistor. One of a source electrode and a drain electrode of the driving transistor is connected to a power source line while the other is connected to the pixel electrode of the light-emitting element. A gate electrode of the AC transistor is connected to the power source line, and one of a source electrode and a drain electrode of the AC transistor is connected to the pixel electrode while the other is connected to a current lead-in line. The driving transistor and the AC transistor have the same conductivity type. The driving transistor operates in the saturation region while the AC transistor operates in the linear region. The AC transistor is not operated after it is mounted on an electronic appliance. This is because no circuit for operating the AC transistor is provided after mounting the AC transistor on an electronic appliance, thereby the reduction of component areas and the cost reduction of the components can be achieved.

A display device of the invention includes pixels each having a light-emitting element, a driving transistor for controlling the amount of a forward current flowing to the light-emitting element, a switching transistor for controlling input of a video signal, and an AC transistor for controlling a reverse current flowing to the light-emitting element. The light-emitting element includes a pixel electrode and a counter electrode. A gate electrode of the switching transistor is connected to a gate signal line, and one of a source electrode and a drain electrode of the switching transistor is connected to a source signal line through which a video signal flows while the other is connected to a gate electrode of the driving transistor. One of a source electrode and a drain electrode of the driving transistor is connected to a power source line while the other is connected to the pixel electrode of the light-emitting element. A gate electrode of the AC transistor is connected to the power source line, and one of a source electrode and a drain electrode of the AC transistor is connected to the pixel electrode while the other is connected to the power source line. The driving transistor and the AC transistor have the same conductivity type. The driving transistor operates in the saturation region while the AC transistor operates in the linear region. The AC transistor is not operated after it is mounted on an electronic appliance. This is because no circuit for operating the AC transistor is provided after mounting the AC transistor on an electronic appliance, thereby the reduction of component areas and the cost reduction of the components can be achieved.

According to a driving method of a display device of the invention, one frame period is divided into a plurality of sub-frame periods, and a writing period and a display period are provided in each sub-frame period. In the writing period, light emission or non-light emission of a light-emitting element is set by using a switching transistor and a driving transistor, and a reverse current is flown to the light-emitting element. In the display period, the light-emitting element is operated in accordance with the setting performed to the light-emitting element during the writing period. Thus, by controlling the total light-emitting period of the light-emitting element, gray scales are displayed.

According to a driving method of a display device of the invention, one frame period is divided into a plurality of sub-frame periods and a plurality of reverse bias periods, and a writing period and a display period are provided in each sub-frame period. In the writing period, light emission or non-light emission of a light-emitting element is set by using a switching transistor and a driving transistor. In the display period, the light-emitting element is operated in accordance with the setting performed to the light-emitting element during the writing period. In the reverse bias period, a reverse current is flown to the light-emitting element. Thus, by controlling the total light-emitting period of the light-emitting element, gray scales are displayed.

A display device of the invention includes pixels each including a light-emitting element, a driving transistor for controlling the amount of a forward current flowing to the light-emitting element, and a switching transistor for controlling input of a video signal. The driving transistor operates in the linear region, and an AC driver circuit for applying an AC signal to the light-emitting element through the driving transistor is provided, which is not operated after being mounted on an electronic appliance. This is because no circuit for operating the AC transistor is provided after mounting the AC driver circuit on an electronic appliance, thereby the reduction of component areas and the cost reduction of the components can be achieved.

A display device of the invention includes pixels each having a light-emitting element, a driving transistor for controlling the amount of a forward current flowing to the light-emitting element, and a switching transistor for controlling input of a video signal. The light-emitting element includes a pixel electrode and a counter electrode. A gate electrode of the switching transistor is connected to a gate signal line, and one of a source electrode and a drain electrode of the switching transistor is connected to a source signal line through which the video signal flows while the other is connected to a gate electrode of the driving transistor. One of a source electrode and a drain electrode of the driving transistor is connected to a power source line while the other is connected to the pixel electrode of the light-emitting element. The driving transistor operates in the linear region, and an AC driver circuit for applying an AC signal to the light-emitting element through the driving transistor is provided, which is not operated after being mounted on an electronic appliance. This is because no circuit for operating the AC transistor is provided after mounting AC driver circuit on an electronic appliance, thereby the reduction of component areas and the cost reduction of the components can be achieved.

According to a driving method of a display device of the invention, one frame period is divided into a plurality of sub-frame periods and a single reverse bias period, and a writing period and a display period are provided in each sub-frame period. In the writing period, light emission or non-light emission of a light-emitting element is set by using a switching transistor and a driving transistor. In the display period, the light-emitting element is operated in accordance with the setting performed to the light-emitting element during the writing period. In the reverse bias period, a reverse current is flown to the light-emitting element. Thus, by controlling the total light-emitting period of the light-emitting element, gray scales are displayed.

According to a driving method of a display device of the invention, one frame periods is divided into a forward bias period and a reverse bias period. In the forward bias period, a forward current is flown to the light-emitting element by using the switching transistor and the driving transistor, and the light-emitting element is controlled to emit light at a luminance corresponding to the amount of current flowing thereto. In the reverse bias period, a reverse current is flown to the light-emitting element.

According to the aforementioned structures, a constant current can be flown to a light-emitting element when a forward driving voltage is applied to the light-emitting element while a sufficiently large current for insulating a short-circuit portion can be flown to a short-circuit portion when a reverse driving voltage is applied to the light-emitting element, thereby the life of the light-emitting element can be prolonged.

In addition, according to the invention, AC drive is performed after sealing, and no circuit for performing AC drive is provided after mounting the AC driver circuit on an electronic appliance; therefore, the reduction of component areas and the cost reduction of components are achieved.

DETAILED DESCRIPTION OF THE INVENTION

Although the invention will be fully described by way of embodiment modes and embodiments with reference to the accompanying drawings, it is to be understood that various changes and modifications will be apparent to those skilled in the art. Therefore, unless otherwise such changes and modifications depart from the scope of the invention, they should be construed as being included therein.

Embodiment Mode 1

Figure 1:
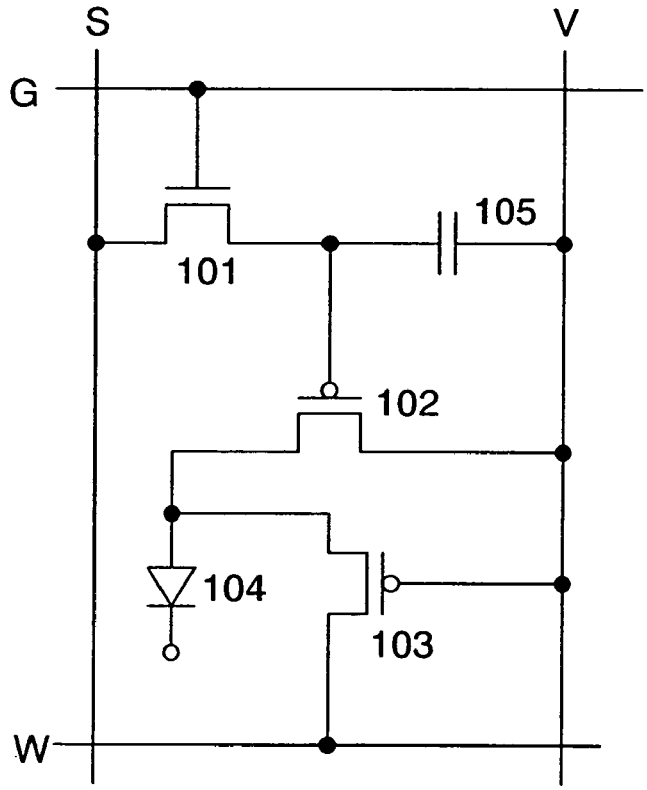
FIG. 1 is a circuit diagram of a pixel used in the display device of the invention.

One embodiment mode of the invention is shown in FIG. 1.

FIG. 1 shows one embodiment mode of a pixel included in the light-emitting device of the invention. The pixel shown in FIG. 1 includes a light-emitting element 104, a transistor (switching transistor) 101 used as a switching element for controlling a video signal input to the pixel, a driving transistor 102 for controlling the current value flowing to the light-emitting element 104, and an AC transistor 103 for flowing a current to the light-emitting element 104 when a reverse driving voltage is applied thereto. Further, a capacitor 105 for holding a potential of video signals may be provided in the pixel as shown in this embodiment mode.

In this specification, description is made on the assumption that the light-emitting element is an element (OLED element) having a structure that an electroluminescent layer which emits light with an electric field generated therein is interposed between an anode and a cathode; however, the invention is not limited to this.

In addition, in this specification, description is made on the assumption that the light-emitting element is an element which emits light by utilizing both the luminescence generated when an excited singlet state returns to a ground state (fluorescence) and the luminescence generated when an excited triplet state returns to a ground state (phosphorescence).

The electroluminescent layer includes a hole-injection layer, hole-transporting layer, a light-emitting layer, an electron-transporting layer, an electron-injection layer and the like. The light-emitting element is basically described as a stacked structure of an anode, a light-emitting layer and a cathode in this order; however, alternatively, such a stacked structure may be employed that an anode, a hole-injection layer, a light-emitting layer, an electron-injection layer and a cathode are stacked in this order; an anode, a hole-injection layer, a hole-transporting layer, a light-emitting layer, an electron-transporting layer, an electron-injection layer and a cathode are stacked in this order; or the like Note that the electroluminescent layer is not limited to a stacked structure in which a hole-injection layer, a hole-transporting layer, a light-emitting layer, an electron transporting layer, an electron-injection layer and the like are clearly distinguished. That is, the electroluminescent layer may have a structure in which materials of a hole-injection layer, a hole-transporting layer, a light-emitting layer, an electron-transporting layer, an electron-injection layer and the like are mixed.

In addition, an inorganic substance may be mixed in the electroluminescent layer as well.

The electroluminescent layer of the OLED element may be formed of any of a low-molecular-weight material, a high-molecular-weight material and a medium-molecular-weight material.

Note that in this specification, the medium-molecular-weight material means the material having no sublimation property in which the number of molecules is 20 or less, and the length of the chained molecules is 10 μm or shorter.

The driving transistor 102 and the AC transistor 103 have the same conductivity type.

A gate electrode of the switching transistor 101 is connected to a gate signal line G. One of a source electrode and a drain electrode of the switching transistor 101 is connected to a source signal line S while the other is connected to a gate electrode of the driving transistor 102. The driving transistor 102 is connected to a power source line V and the light-emitting element 104 so that a current supplied from the power source line V is supplied to the light-emitting element 104 as a drain current of the driving transistor 102. In this embodiment mode, a gate electrode of the AC transistor 103 is connected to the power source line V and one of a source electrode and a drain electrode thereof is connected to a current lead-in line W while the other is connected to a pixel electrode of the light-emitting element 104.

In this specification, in the case where the source electrode or the drain electrode of the driving transistor 102 is connected to an anode of the light-emitting element 104, the anode of the light-emitting element 104 is called a pixel electrode while a cathode thereof is called a counter electrode. On the other hand, in the case where the source electrode or the drain electrode of the driving transistor 102 is connected to a cathode of the light-emitting element 104, the cathode of the light-emitting element 104 is called a pixel electrode while an anode thereof is called a counter electrode.

In the case where the anode is connected to the driving transistor 102 as shown in FIG. 1, the anode is a pixel electrode while the cathode is a counter electrode.

One of the two electrodes of the capacitor 105 is connected to the power source line V while the other is connected to the gate electrode of the driving transistor 102. The capacitor 105 is provided for holding a potential difference between the two electrodes of the capacitor 105 when the switching transistor 101 is not selected (off). Note that although FIG. 1 shows the configuration having the capacitor 105, the invention is not limited to this, and a configuration having no capacitor 105 may be employed as well.

In FIG. 1, the driving transistor 102 and the AC transistor 103 are p-channel transistors, and the drain electrode of the driving transistor 102 is connected to the anode of the light-emitting element 104. On the other hand, when the driving transistor 102 and the AC transistor 103 are n-channel transistors, the source electrode of the driving transistor 102 is connected to the cathode of the light-emitting element 104. In this case, the cathode of the light-emitting element 104 is a pixel electrode while the anode thereof is a counter electrode.

Further, in this embodiment mode, L/W of the driving transistor 102 is set to be higher than that of the AC transistor 103, and the driving transistor 102 is operated in the saturation region while the AC transistor 103 is operated in the linear region. Specifically, L of the driving transistor 102 is set to be longer than W thereof, and more desirably, when L/W is set to be X/1, X is set to be 5 or larger. As for the AC transistor 103, L is set to be equal or shorter than W thereof.

Figure 2A:
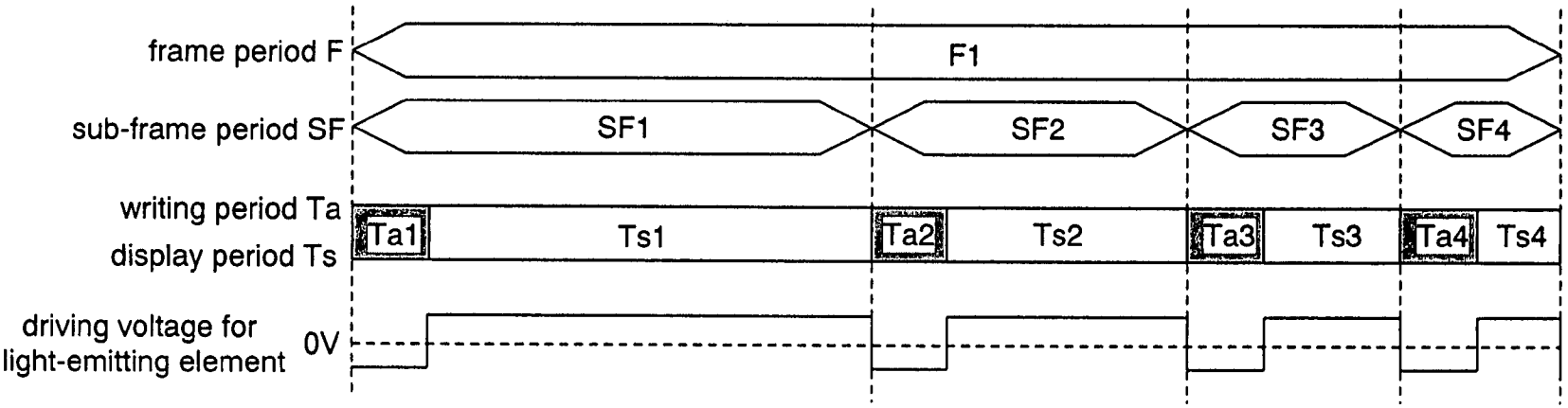
FIGS. 2A and 2B are timing charts in the case where the display device of the invention is driven by a digital time gray scale method.
Figure 2B:
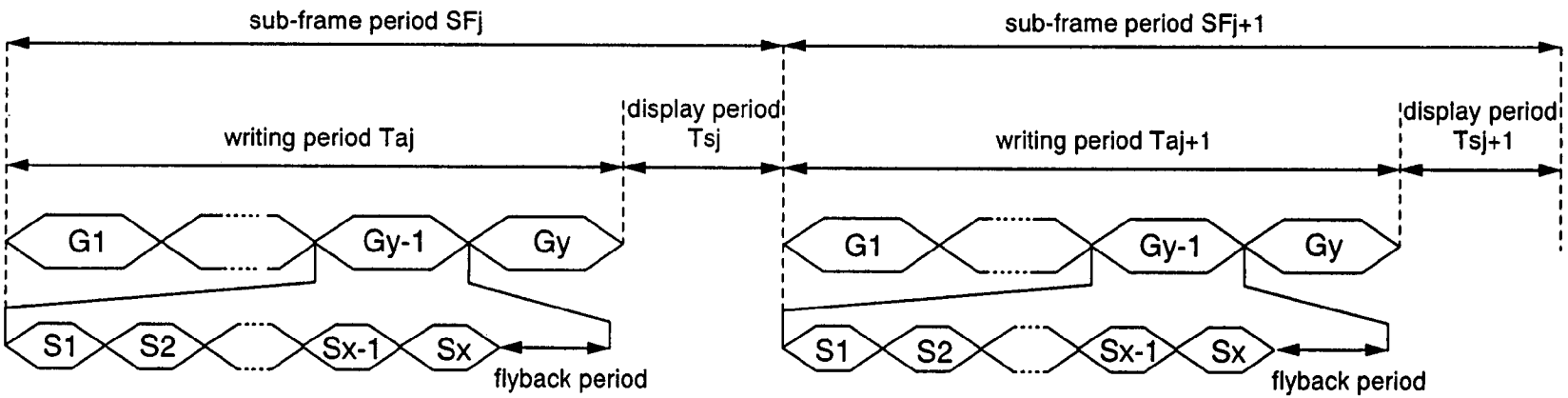

Next, description is made with reference to timing charts of FIGS. 2A and 2Bon a method for driving the pixel shown in FIG. 1 using a digital time gray scale method.

In FIGS. 2A and 2B, one frame includes a plurality of sub-frame periods, and one sub-frame period includes a writing period and a display period. Note that FIG. 2 shows an example where gray scales are displayed using 4-bit digital video signals.

First, upon selection of the gate signal line G in the writing period, the switching transistor 101 having the gate electrode connected to the gate signal line G is turned on. Then, a digital video signal inputted to the source signal line S is inputted to the gate electrode of the driving transistor 102 through the switching transistor 101, and a charge is held in the capacitor 105.

In this specification, "a transistor is on" means that "a source electrode and a drain electrode thereof are electrically conducted by the gate voltage". In addition, "a transistor is off" means that "a source electrode and a drain electrode thereof are not electrically conducted by the gate voltage".

The light-emitting element 104 in each pixel is applied a reverse driving voltage. That is, the potential of the power source line V is constant but only the potential of the counter electrode of the light-emitting element 104 is changed. Therefore, the light-emitting element 104 does not emit light, and a reverse-bias current flowing in the light-emitting element 104 flows to the current lead-in line W through the source electrode and the drain electrode of the AC transistor 103. At this time, the potential of the current lead-in line W is set to have a level which does not flow a reverse-bias current flowing in the light-emitting element 104 to the driving transistor 102.

Note that in this specification, "to apply a forward driving voltage to a light-emitting element" means that "a potential of an anode of the light-emitting element is set higher than that of a cathode thereof". At this time, a forward-bias current flows to the light-emitting element, which emits light accordingly. Meanwhile, "to apply a reverse driving voltage to a light-emitting element" means that "a potential of a cathode of the light-emitting element is set higher than that of an anode thereof". At this time, reverse-bias current flows to the light-emitting element, which does not emit light accordingly.

In the display period, the switching transistor 101 is turned off by controlling the potential of the gate signal line G, and a potential of the digital video signal which is written in the writing period is held in the capacitor 105. By changing potentials of the counter electrodes of the light-emitting elements 104 included in the whole pixels, a forward driving voltage is applied to the light-emitting elements 104 in the whole pixels. Accordingly, in the case where the driving transistor 102 is turned on by the potential held in the capacitor 105 in the writing period, current flows to the light-emitting element 104, which emits light accordingly. On the other hand, in the case where the driving transistor 102 is turned off, no current is supplied to the light-emitting element 104.

By repeating the aforementioned operations in the whole sub-frame periods SF1 to SF4, one frame period F1 terminates. Here, gray scales are displayed by setting the length of display periods Ts1 to Ts4 in the respective sub-frame periods SF1 to SF4, and controlling the total display period of the sub-frame periods SF1 to SF4 within one frame period F1 in which the light-emitting element 104 emits light. That is, gray scales are displayed based on the total light-emitting periods in one frame period F1.

Figure 3A:
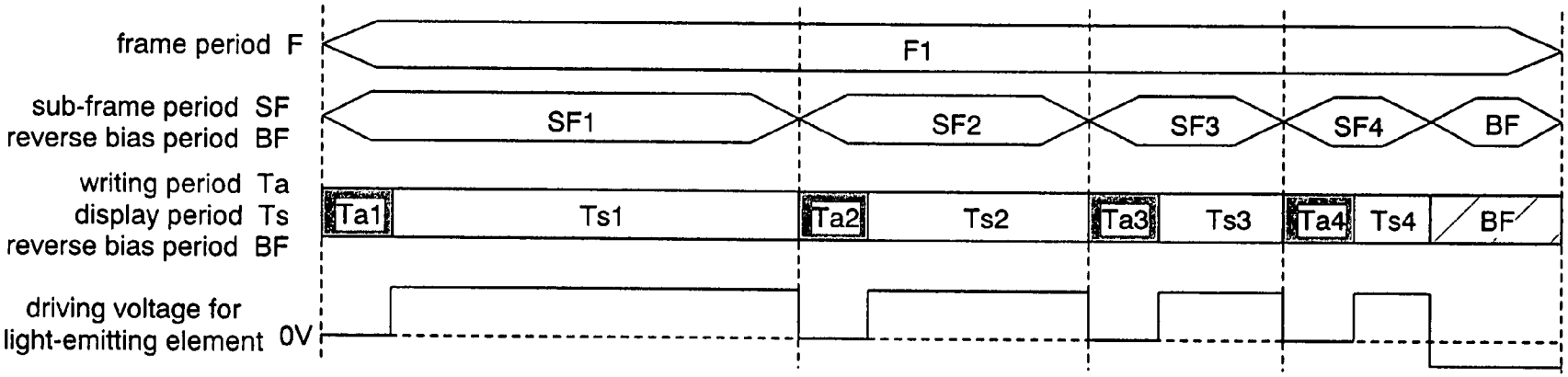
FIGS. 3A and 3B are timing charts in the case where the display device of the invention is driven by a digital time gray scale method.
Figure 3B:
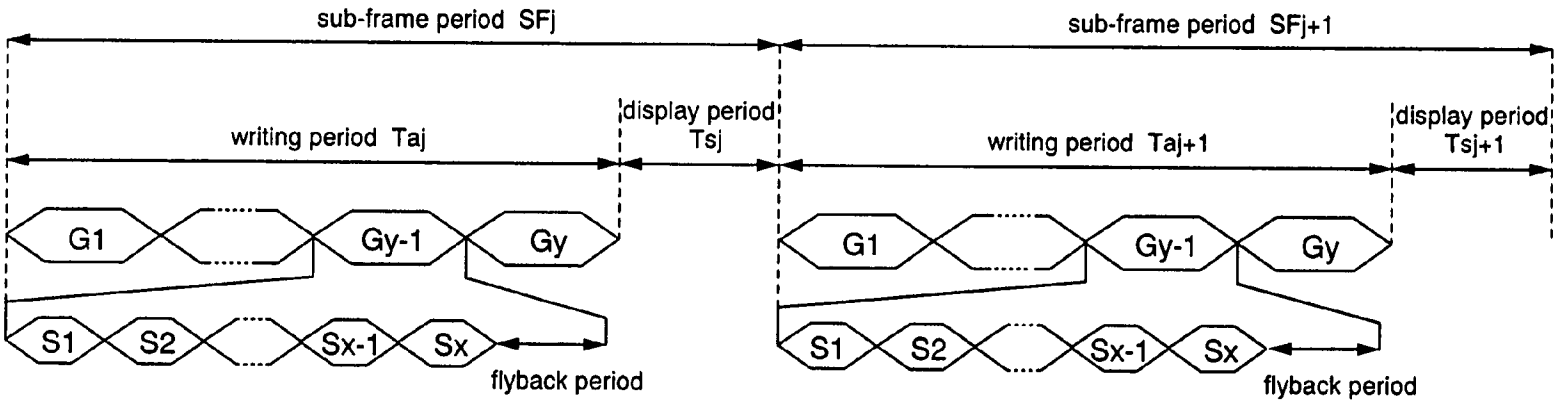

In addition, as shown in FIGS. 3A and 3B, a period for applying a reverse driving voltage to the light-emitting element (reverse bias period) BF may be provided in one frame period and the driving voltage of the light-emitting element may-be set at 0 V in the writing period. Note that FIGS. 3A and 3B show examples where gray scales are displayed using 4-bit digital video signals.

Note also that one sub-frame period may be further divided into a plurality of sub-frame periods, which may be arranged at random in one frame period.

Figure 4A:
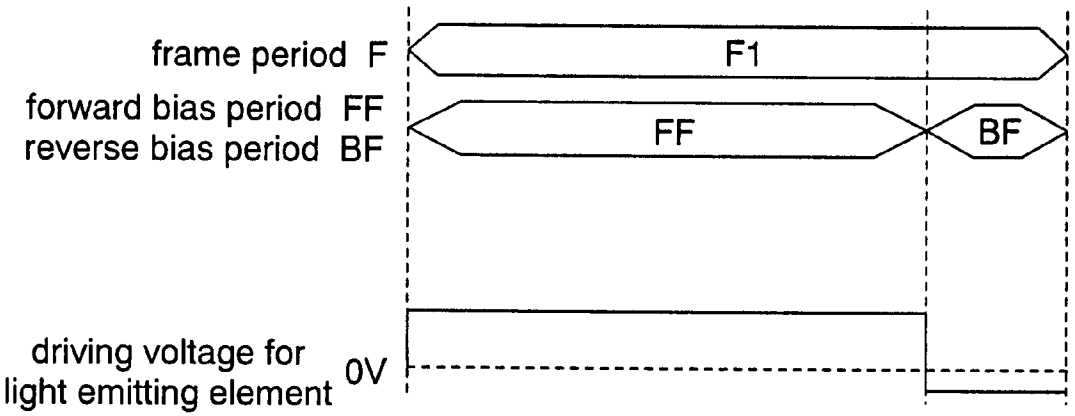
FIGS. 4A and 4B are timing charts in the case where the display device of the invention is driven by an analog gray scale method to display gray scales.
Figure 4B:
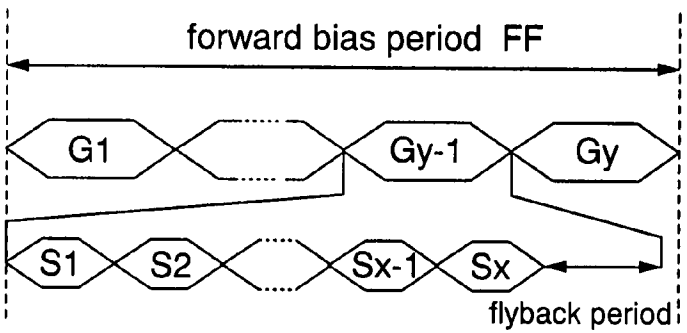

In the case of driving the pixel in FIG. 1 by an analog method, one frame period may have a period for applying a forward driving voltage to the light-emitting element, namely a forward bias period FF, and a period for applying a reverse driving voltage to the light-emitting element, namely a reverse bias period BF as shown in FIGS. 4A and 4B. Note that an analog video signal may be written to each pixel in the forward bias period FF so that the light-emitting element 104 emits light.

A transistor used in the invention may be a transistor formed by using single crystalline silicon, a transistor using SOI, or a thin film transistor using polycrystalline silicon, amorphous silicon or microcrystalline semiconductor (including a semi-amorphous semiconductor). Further, it may be a transistor using an organic semiconductor or carbon nanotube. The transistor provided in each pixel of the light-emitting device of the invention may have a single-gate structure, a double-gate structure or a multi-gate structure having more than two gate electrodes.

Note that the semi-amorphous semiconductor is a semiconductor having an intermediate structure between amorphous and crystalline (including single crystalline and polycrystalline) structures, and the semiconductor has a third state which is stable in free energy. The semi-amorphous semiconductor includes a crystalline region having a short-range order and lattice distortion. At least a part of a region in the semiconductor film includes crystal grains of 0.5 to 20 nm. It has another characteristic that the Raman spectrum is shifted to the lower wavenumber than 520 $cm^{-1}$, and diffraction peaks are observed at (111) and (220) by the X-ray diffraction, which are supposedly derived from the Si-crystal lattices. In addition, it contains hydrogen or halogen with a concentration of 1 atomic % or more in order to terminate dangling bonds.

A semi-amorphous semiconductor film is formed by decomposing a silicide gas by glow discharge (by plasma CVD). The silicide gas includes $SiH_4$ as well as $Si_2H_6$, $SiH_2Cl_2$, $SiHCl_3$, $SiCl_4$, $SiF_4$ and the like, which may be mixed with $GeF_4$. In addition, the silicide gas may be diluted with $H_2$, or diluted with $H_2$ and one or more rare gas elements selected from He, Ar, Kr and Ne. It is desirable that the dilution ratio be set in the range of 2 to 1000 times; pressure, in the range of about 0.1 to 133 Pa; and power supply frequency, in the range of 1 to 120 MHz, or more preferably in the range of 13 to 60 MHz. In addition, the substrate is preferably heated to 300° C. or lower, and preferably 100 to 250° C. As the impurities contained in the semiconductor film, atmospheric impurities such as oxygen, nitrogen and carbon are desirably set at the concentration of $1\times10^{20}$ $cm^{-1}$ or less. In particular, oxygen concentration is preferably $5\times10^{19}$ $cm^3$ or less, or more preferably $1\times10^{19}$ $cm^3$ or less. A TFT formed under such conditions can exhibit the electron field-effect mobility of $\mu$=1 to 10 $cm^2$/Vsec.

According to the aforementioned structures, a constant current can be flown to a light-emitting element when a forward driving voltage is applied to the light-emitting element while a sufficiently large current for insulating a short-circuit portion can be flown to the short-circuit portion when a reverse driving voltage is applied to the light-emitting element, thereby the life of the light-emitting element can be prolonged.

Figure 18:
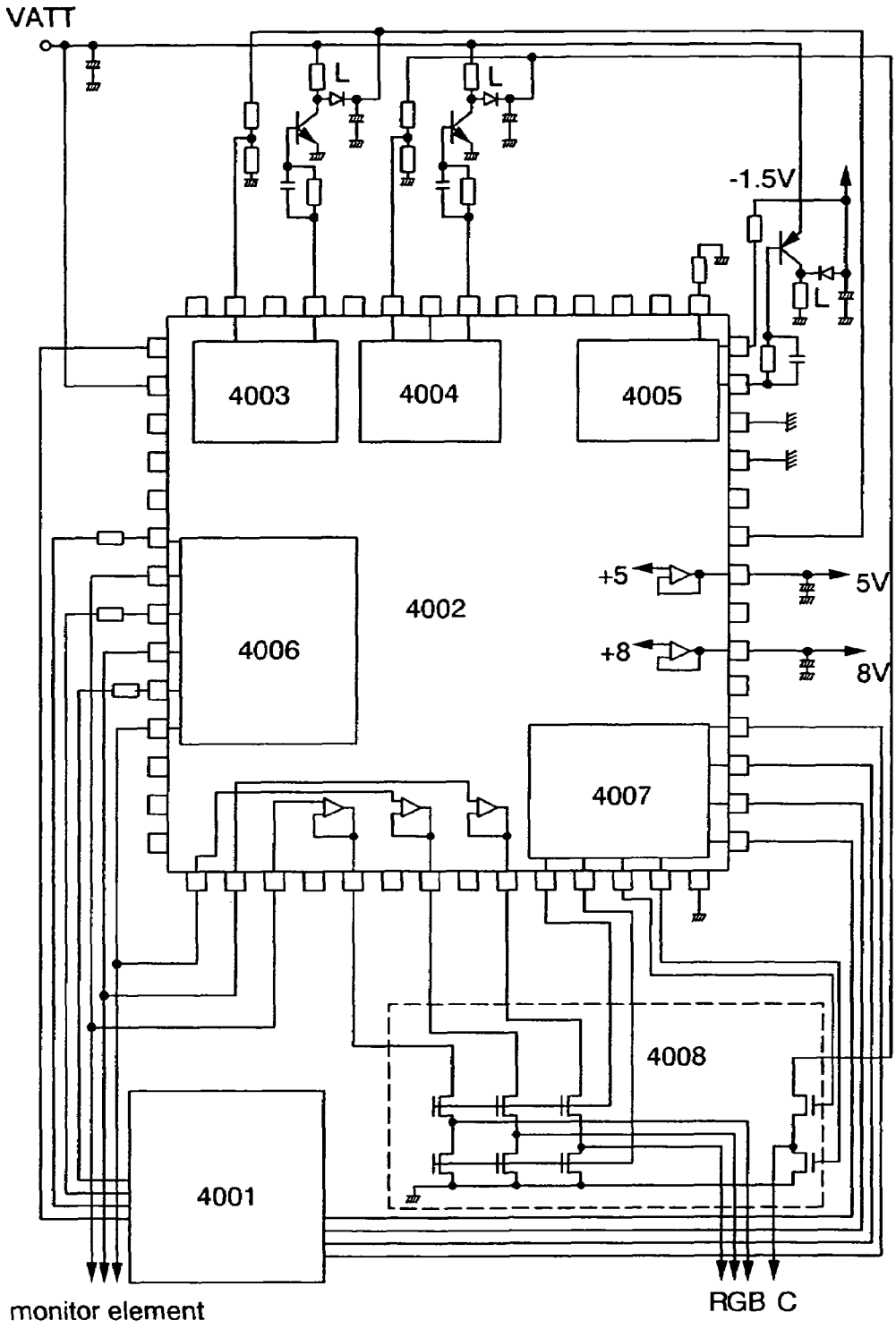
FIG. 18 is a diagram showing a power source circuit and a peripheral circuit thereof of the display device of the invention.

FIG. 18 shows a power source circuit and a peripheral circuit thereof in a display device. The power source circuit and the peripheral circuit thereof include a power source IC 4002 and peripheral components thereof. The power source IC includes switching regulators 4003, 4004 and 4005, operational amplifiers, a constant current source 4006 and a level shifter 4007. A voltage VATT from a battery is stepped up or down in the switching regulators 4003, 4004 and 4005 to be supplied to a panel. In the AC drive, a signal from a controller IC 4001 is stepped up in the level shifter 4007 and then supplied to a switching circuit 4008. Description is made below on the operation of the switching circuit 4008. First, in the normal operation, that is when a forward voltage is applied to the light-emitting element, a current flows to R, G and B terminals (hereinafter referred to as RGB) of the panel through switches connected to the outputs of the operational amplifiers. Meanwhile, a cathode (C) is connected to GND. However, it is not limited to GND so long as a voltage high enough for light emission is secured. Next, when a reverse voltage is applied to the light-emitting element, the RGB are connected to GND through the switching circuit 4008 respectively. Meanwhile, the cathode (C) is connected to the output of the switching regulator 4004. In this manner, the output voltage of the switching regulator 4004 is sufficiently higher than GND; therefore, a reverse voltage is applied to the light-emitting element.

Figure 20:
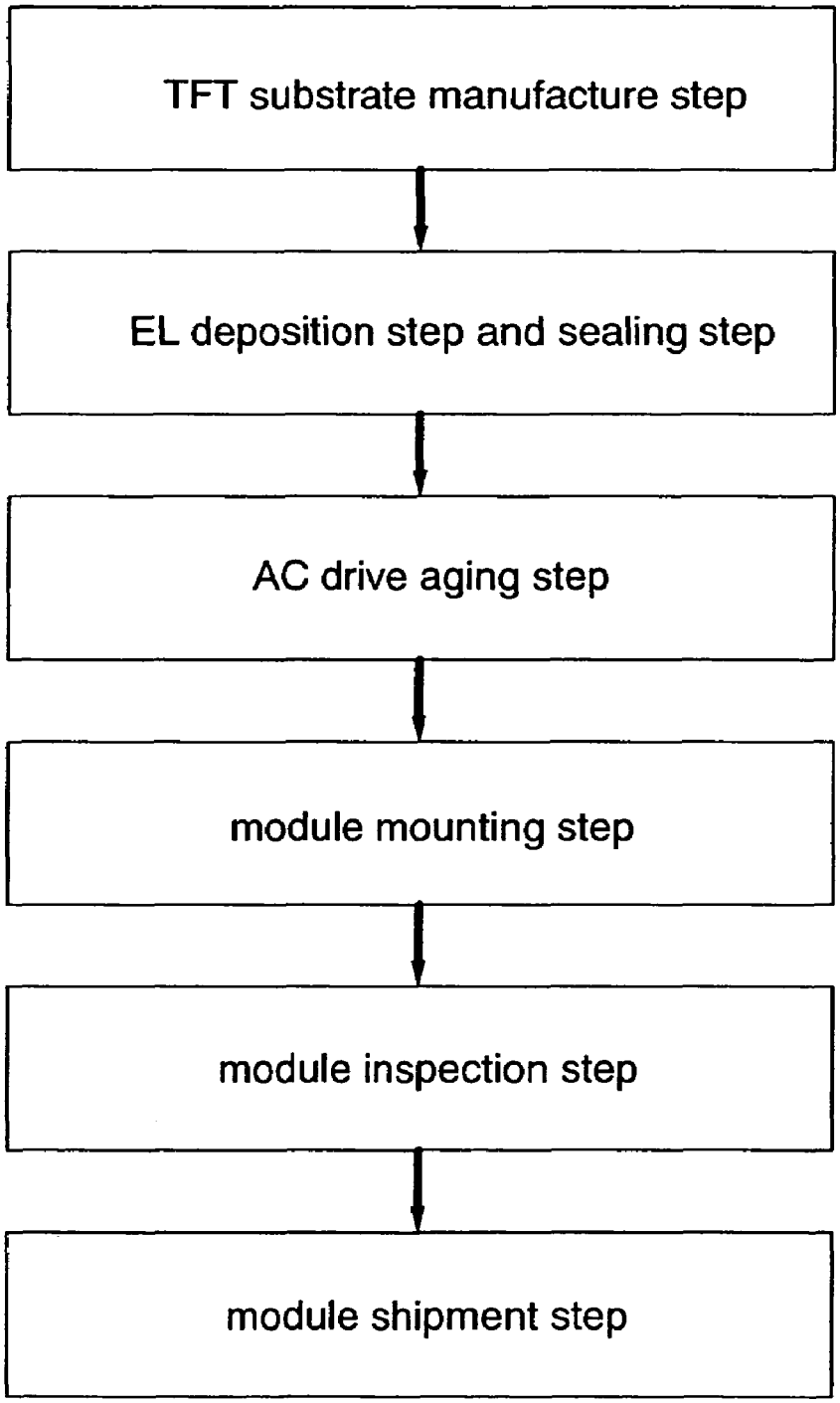
FIG. 20 is a manufacture flow chart.

FIG. 20 shows a manufacture flow of a display device using light-emitting elements. After the completion of a TFT substrate manufacture step, an EL deposition step and a sealing step are carried out. After that, an aging step is carried out for a predetermined period. At this time, the aforementioned AC drive is performed in regular cycles. For the power source circuit and the peripheral circuit thereof, a circuit having an AC drive switching circuit is used as shown in FIG. 18. After the aging step, product inspection is carried out to complete the manufacture.

Figure 19:
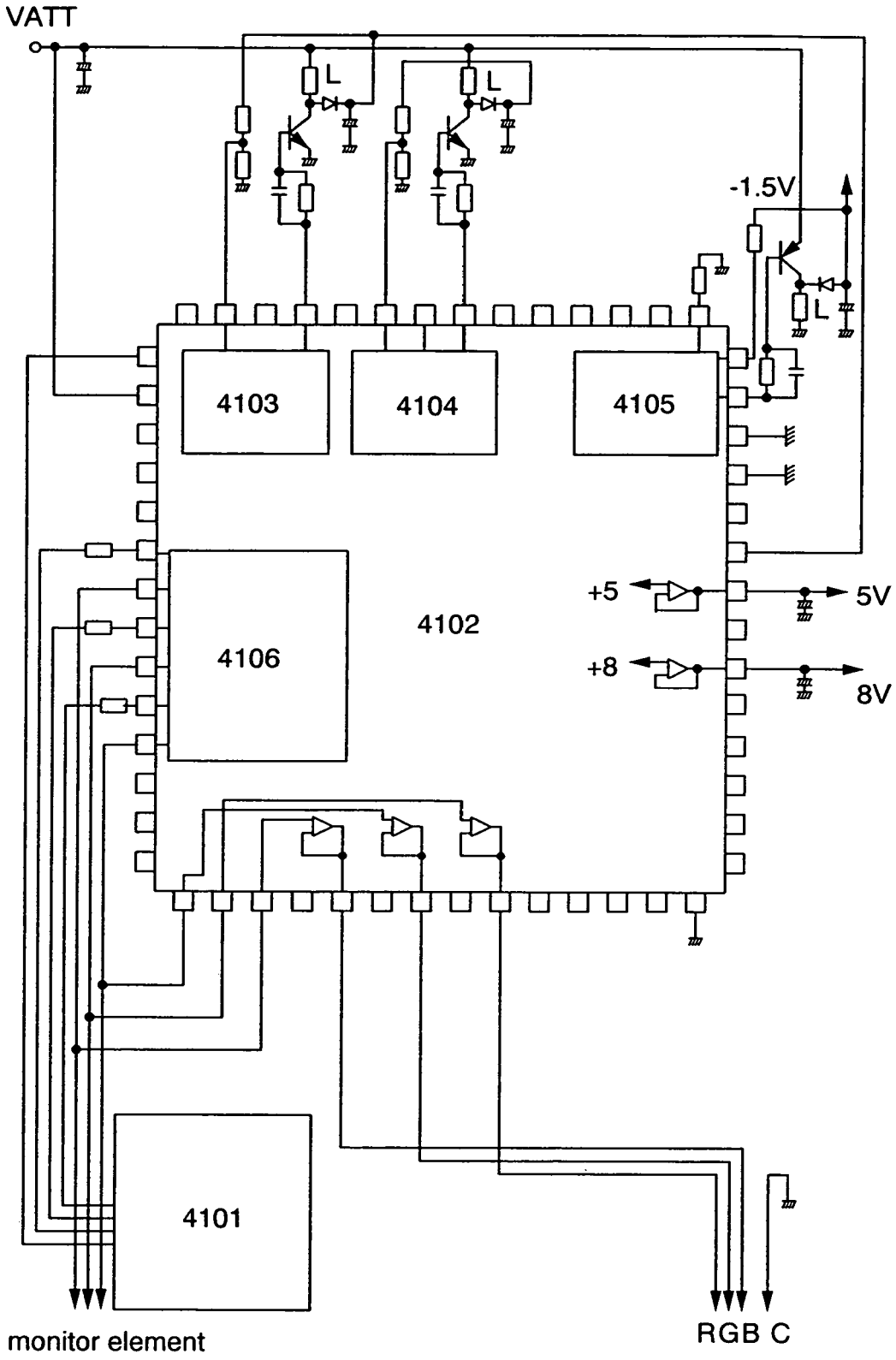
FIG. 19 is a diagram showing a power source circuit and a peripheral circuit thereof of the display device of the invention.

FIG. 19 shows a power source circuit and a peripheral circuit thereof at the stage of being mounted on an electronic appliance after the aging step. The power source circuit and the peripheral circuit thereof include a power source IC 4102 and peripheral components thereof. The power source IC includes switching regulators 4103, 4104 and 4105, operational amplifiers and a constant current source 4106. Note that reference numeral 4101 denotes a controller IC. A voltage VATT from a battery is stepped up or down in switching regulators 4103, 4104 and 4105 to be supplied to a panel. RGB are connected to the outputs of operational amplifiers respectively, and a cathode (C) is connected to GND. However, it is not limited to GND so long as a voltage high enough for light emission is secured. The switching circuit as shown in FIG. 18 is not used. If an initial defect is removed in the aging step and a progressive defect is not generated, AC drive is not required to be performed after mounting the AC driver circuit on an electronic appliance. By providing no switching circuit, the number of components can be reduced from 38 to 30, thus the reduction can be achieved by 20%. In particular, the number of semiconductor elements can be reduced from 14 to 6, thus the reduction can be achieved by 60%, which contributes to the reduction in component areas after packaging and the cost reduction of the components. In addition, the power source IC 4102 is not required to have a level shifter circuit, which contributes to the cost reduction of the power source IC. AC drive elements in pixels and an AC driver circuit provided in the driver circuit for driving pixels remain disposed inside the display device; however, it does not cause a problem as the cost is not increased. The AC driver circuit can be controlled so as not to operate after being mounted on an electronic appliance. Note that the AC driver circuit comprises the switching circuit 4008 and the like.

Embodiment Mode 2

In this embodiment mode, description is made on a pixel included in the light-emitting device of the invention which is a different mode from that in FIG. 1.

Figure 5:
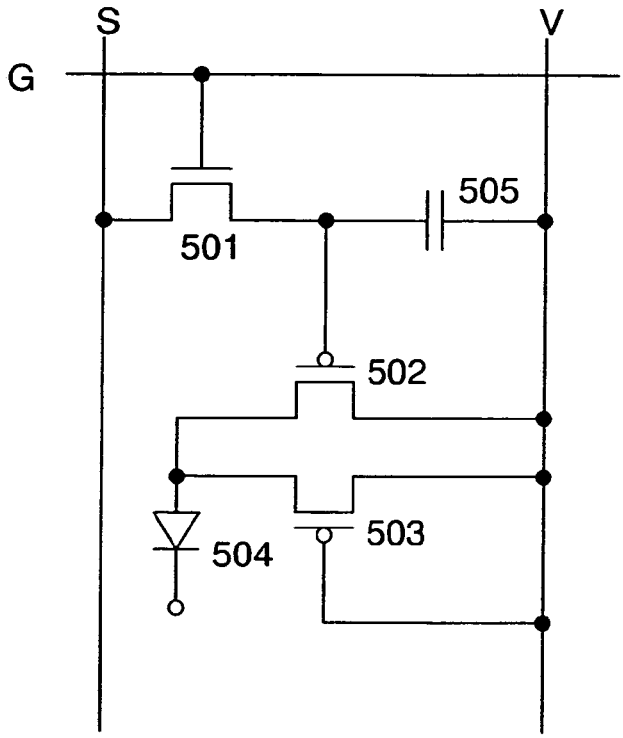
FIG. 5 is a circuit diagram of a pixel used in the display device of the invention.

The pixel shown in FIG. 5 includes a light-emitting element 504, a switching transistor 501, a driving transistor 502 and an AC transistor 503. In addition to the aforementioned elements, a capacitor 505 may be provided in the pixel.

The driving transistor 502 and the AC transistor 503 have the same conductivity type.

Further, in this embodiment mode, L/W of the driving transistor 502 is set higher than that of the AC transistor 503, and the driving transistor 502 is operated in the saturation region while the AC transistor 503 is operated in the linear region. Specifically, L of the driving transistor 502 is set longer than W thereof, and more desirably, when L/W is set to be X/1, X is set to be 5 or larger. As for the AC transistor 503, L is set to be equal or shorter than W thereof.

Although the switching transistor 501 is an n-channel transistor and the driving transistor 502 and the AC transistor 503 are p-channel transistors in FIG. 5, each of the switching transistor 501, the driving transistor 502 and the AC transistor 503 may be either a p-channel transistor or an n-channel transistor.

A gate electrode of the switching transistor 501 is connected to a gate signal line Q One of a source electrode and a drain electrode of the switching transistor 501 is connected to a source signal lines S while the other is connected to a gate electrode of the driving transistor 502. The driving transistor 502 is connected to a power source line V and the light-emitting element 504 so that a current supplied from the power source line V is supplied to the light-emitting element 504 as a drain current of the driving transistor 502. In this embodiment mode, a gate electrode of the AC transistor 503 is connected to the power source line V, and one of a source electrode and a drain electrode thereof is connected to the power source line V while the other is connected to a pixel electrode of the light-emitting element 504.

The light-emitting element 504 includes an anode, a cathode and an electroluminescent layer interposed therebetween. In the case where the anode is connected to the driving transistor 502 as shown in FIG. 5, the anode is a pixel electrode while the cathode is a counter electrode.

One of the two electrodes of the capacitor 505 is connected to the power source line V while the other is connected to the gate electrode of the driving transistor 502. The capacitor 505 is provided for holding a potential difference between the two electrodes of the capacitor 505 when the switching transistor 501 is off. Note that although FIG. 5 shows the configuration having the capacitor 505, the invention is not limited to this, and a configuration having no capacitor 505 may be employed as well.

In FIG. 5, the driving transistor 502 and the AC transistor 503 are p-channel transistors, and a drain electrode of the driving transistor 502 is connected to the anode of the light-emitting element 504. On the other hand, when the driving transistor 502 and the AC transistor 503 are n-channel transistors, a source electrode of the driving transistor 502 is connected to the cathode of the light-emitting element 504. In this case, the cathode of the light-emitting element 504 is a pixel electrode while the anode thereof is a counter electrode.

In the case of driving the pixel shown in FIG. 5 using a digital time gray scale method, the operation may be carried out in accordance with the timing chart in FIGS. 2A, 2B, 3A, or 3B similarly to Embodiment Mode 1.

On the other hand, in the case of driving the pixel shown in FIG. 5 using an analog method, similarly to Embodiment Mode 1, one frame may have a period for applying a forward driving voltage to the light-emitting element, namely a forward bias period FF, and a period for applying a reverse driving voltage to the light-emitting element, namely a reverse bias period BF as shown in FIGS. 4A and 4B. Note that an analog video signal may be written to each pixel in the forward bias period FF so that the light-emitting element 104 emits light.

According to the aforementioned structures, a constant current can be flown to a light-emitting element when a forward driving voltage is applied to the light-emitting element while a sufficiently large current for insulating a short-circuit portion can be flown to the short-circuit portion when a reverse driving voltage is applied to the light-emitting element, thereby the life of the light-emitting element can be prolonged.

Embodiment Mode 3

Figure 17:
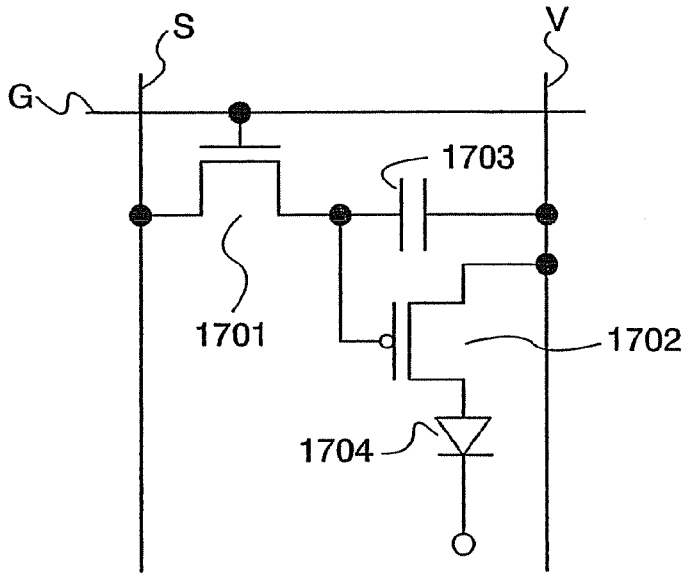
FIG. 17 PRIOR ART
FIG. 17 is a circuit diagram of a pixel of a conventional display.

In this embodiment mode, description is made on a mode of a light-emitting device of the invention which uses the pixel shown in FIG. 17.

The pixel shown in FIG. 17 includes a light-emitting element 1704, a switching transistor 1701 and a driving transistor 1702. In addition to the aforementioned elements, a capacitor 1703 may be provided in the pixel.

When a forward voltage or a reverse voltage is applied to the light-emitting element 1704, the driving transistor 1702 is turned on in the linear region. At this time, the on resistance of the driving transistor 1702 is sufficiently smaller than the resistance of the light-emitting element, and the voltage between a cathode and an anode of the light-emitting element is approximately equal to the voltage of the cathode and the wiring V. By driving the voltage of the cathode and the wiring V alternately, the light-emitting element can be driven alternately.

In this embodiment mode also, AC drive can be performed only in the aging step as described in Embodiment Mode 1, and after mounting an AC driver circuit on an electronic appliance, AC drive is not performed. Accordingly, the cost reduction of the power source circuit and a peripheral circuit thereof can be achieved as well as the reduction in the mounting area thereof can be achieved. The internal AC driver circuit can be controlled so as not to operate after it is mounted on an electronic appliance.

An embodiment of the invention is described below.

Embodiment 1

Figure 6:
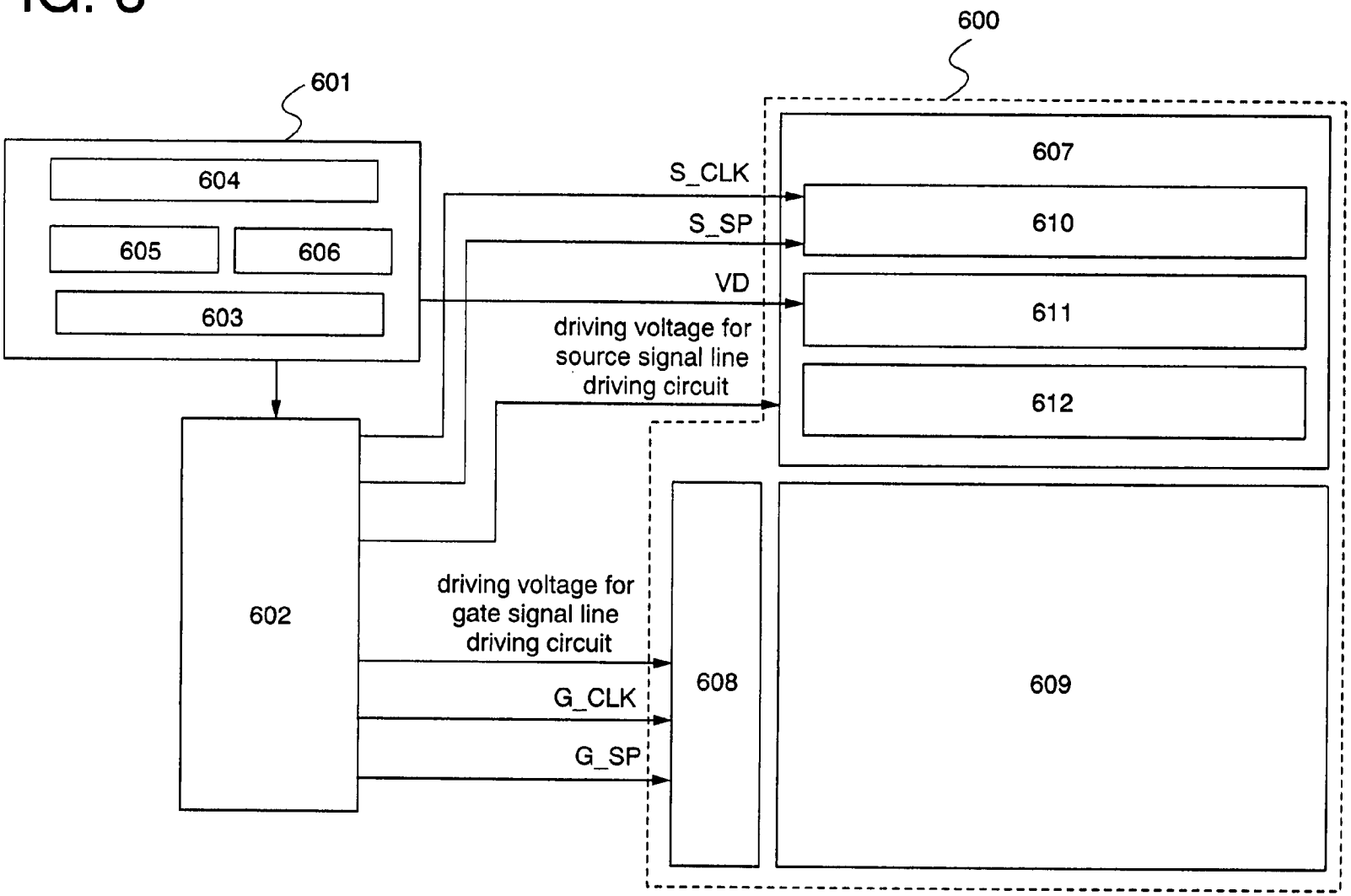
FIG. 6 is a circuit diagram showing a configuration of the display device of the invention (Embodiment 1).

Description is made with reference to FIG. 6 on a circuit which inputs signals for driving a display using a digital time gray scale method to a source signal line driver circuit and a gate signal line driver circuit of the display.

In this embodiment, description is made on an example of a display device for displaying images by inputting 4-bit digital video signals to a display device. However, the invention is not limited to the 4-bit signals.

A signal control circuit 601 reads in a digital video signal, and outputs a digital video signal VD to a display 600.

In this embodiment, a signal obtained by converting a digital video signal in the signal control circuit 601 into a signal to be inputted to the display is called a digital video signal VD.

Signals and driving voltages for driving a source signal line driver circuit 607 and a gate signal line driver circuit 608 in the display 600 are inputted by a display controller 602.

Description is made on a configuration of the signal control circuit 601 and the display controller 602.

The source signal line driver circuit 607 in the display 600 includes a shift register 610, a LAT (A) 611 and a LAT (B) 612. Though not shown, a level shifter, a buffer and the like may be provided. Note that the invention is not limited to such a configuration. Note also that reference numeral 609 denotes a pixel portion.

The signal control circuit 601 includes a CPU 604, a memory A 605, a memory B 606 and a memory controller 603.

Digital video signals inputted to the signal control circuit 601 are controlled by the memory controller 603 and inputted to the memory A 605 through a switch. The memory A 605 has a capacity high enough to store digital video signals for the whole pixels of the display 600. When signals for one frame period are stored in the memory A 605, a signal of each bit is sequentially read out by the memory controller 603, which is then inputted to the source signal line driver circuit 607 as a digital video signal VD.

When the read operation of the signal stored in the memory A 605 starts, a digital video signal corresponding to the next frame period is inputted to the memory B 606 though the memory controller 603, and thus starts to be stored therein. The memory B 606 has, similarly to the memory A 605, a capacity high enough to store digital video signals for the whole pixels of the display 600.

In this manner, the signal control circuit 601 has the memory A 605 and the memory B 606 each of which is capable of storing digital video signals for one frame period. By alternately using the memory A 605 and the memory B 606, digital video signals VD are sampled.

Here, description is made on the signal control circuit 601 which stores signals by alternately using the two memories A 605 and B 606. In general, a display device has a plurality of memories for storing data of a plurality of frames, which can be used alternately.

Figure 7:
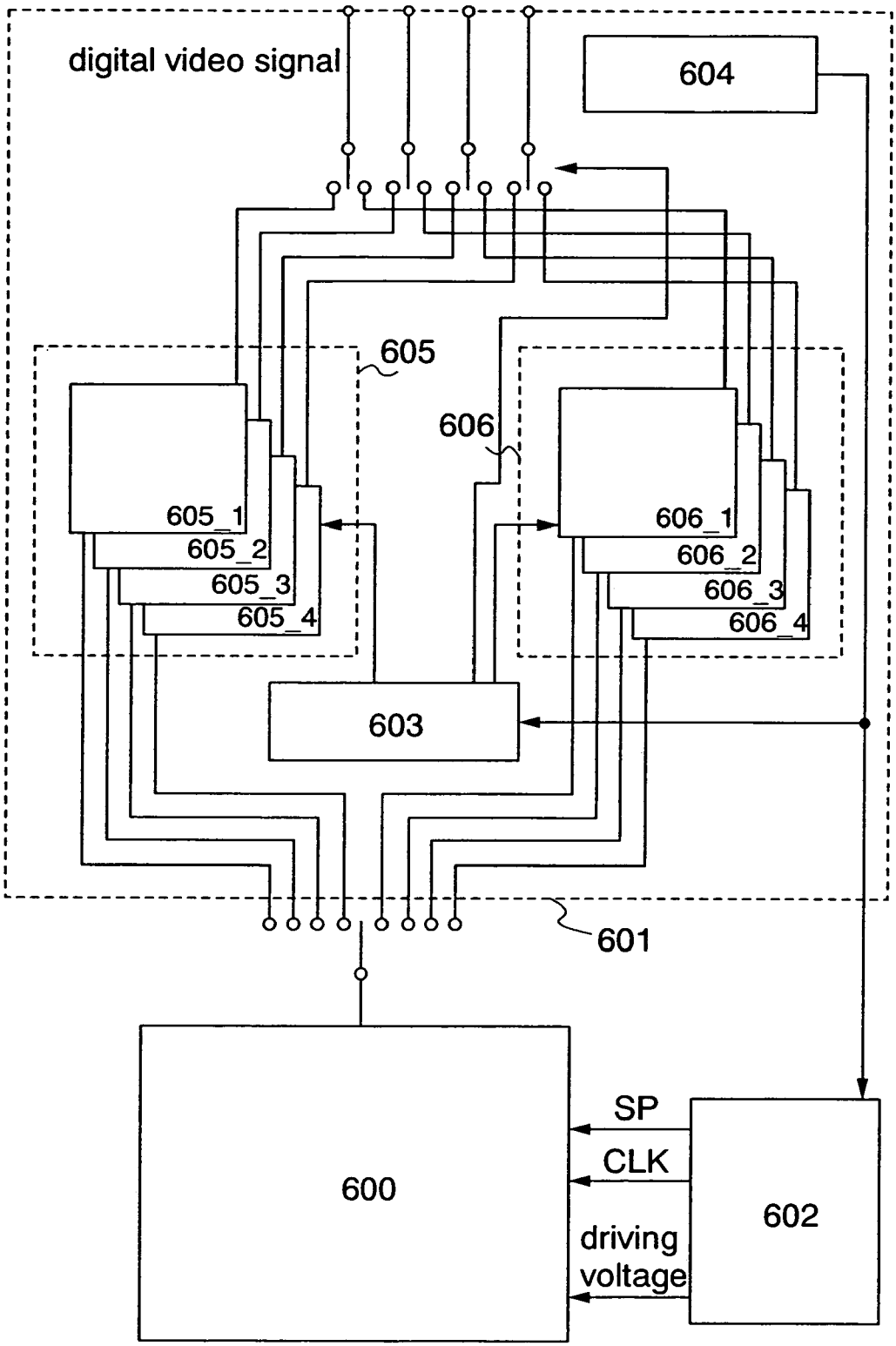
FIG. 7 is a block diagram showing a configuration of the display device of the invention (Embodiment 1).

FIG. 7 is a block diagram of a display device having the aforementioned configuration.

The display device includes the signal control circuit 601, the display controller 602 and the display 600.

The display controller 602 supplies start pulses SP, clock pulses CLK, driving voltages and the like to the display 600.

The signal control circuit 601 includes the CPU 604, the memory A 605, the memory B 606 and the memory controller 603.

The memory A 605 includes memories 605_1 to 605_4 which store data of first to fourth bits of a digital video signal respectively. Similarly, the memory B 606 includes memories 606_1 to 606_4 which store data of first to fourth bits of a digital video signal respectively. The memory corresponding to each bit has memory elements for storing one bit of a signal, in the corresponding number of pixels which constitute one image.

In general, in a display device capable of displaying gray scales using n-bit digital video signals, the memory A 605 includes memories 605_1 to 605_n for storing data of first to n-th bits respectively. Similarly, the memory B 606 includes memories 606_1 to 606_n for storing data of first to n-th bits respectively. The memory corresponding to each bit has a capacity high enough to store one bit of a signal correspondingly to the number of pixels which constitute one image.

Description is made below on the configuration of the display controller 602.

Figure 8:
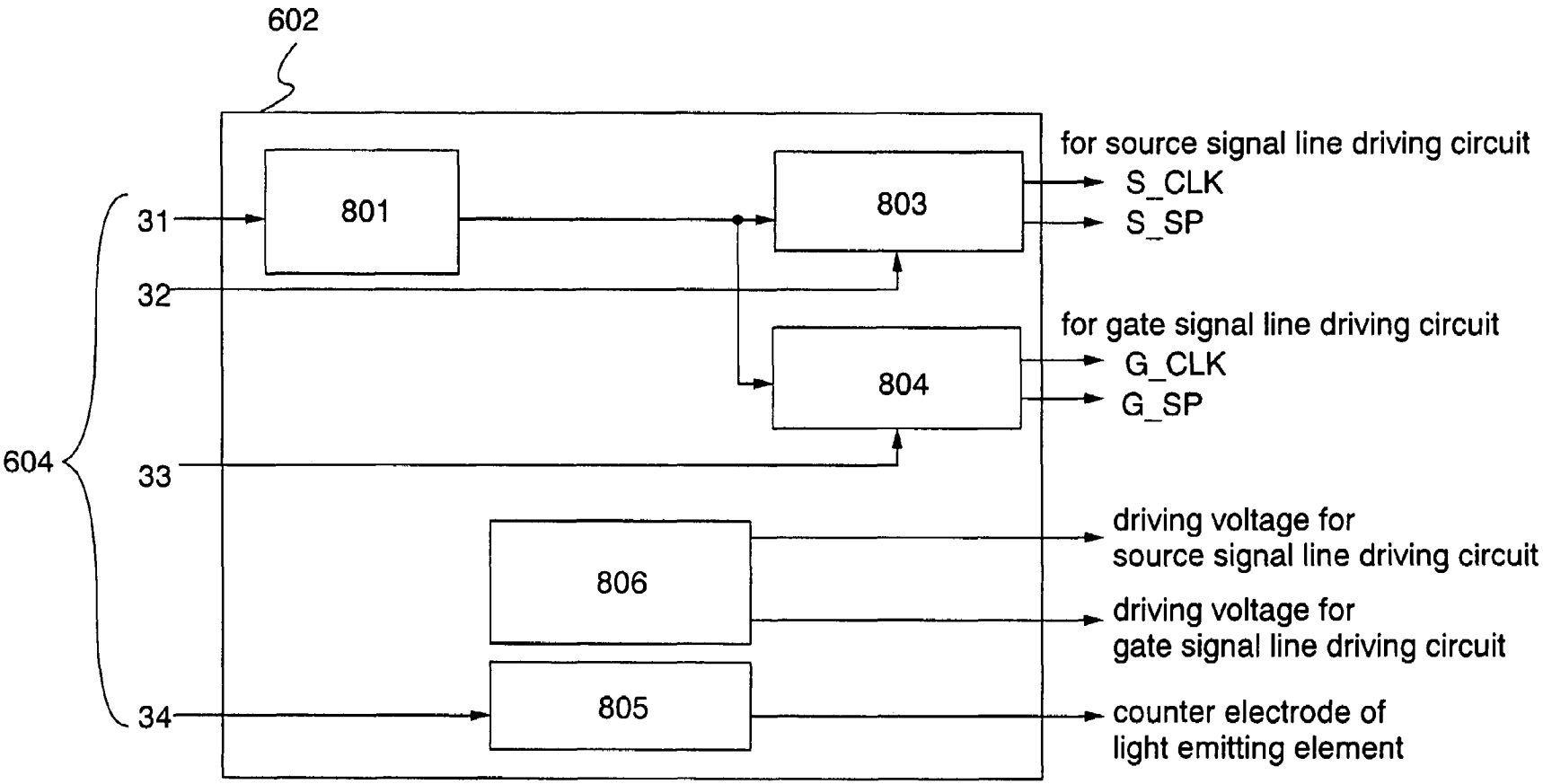
FIG. 8 is a diagram showing a configuration of a display controller used in the display device of the invention (Embodiment 1).

FIG. 8 is a diagram showing a configuration of the display controller of the invention.

The display controller 602 includes a reference clock generating circuit 801, a horizontal clock generating circuit 803, a vertical clock generating circuit 804, a power source control circuit 805 for light-emitting elements, and a power source control circuit 806 for driver circuits.

A clock signal 31 inputted from the CPU 604 is inputted to the reference clock generating circuit 801, which generates a reference clock. The reference clock is inputted to the horizontal clock generating circuit 803 and the vertical clock generating circuit 804.

The horizontal clock generating circuit 803 is inputted with a horizontal synchronization signal 32 for determining a horizontal cycle from the CPU 604, and outputs a clock pulse S_CLK and a start pulse S_SP for the source signal line driver circuit. Similarly, the vertical clock generating circuit 804 is inputted with a vertical synchronization signal 33 for determining a vertical cycle from the CPU 604, and outputs a clock pulse G_CLK and a start pulse G_SP for the gate signal line driver circuit.

The power source control circuit 805 for light-emitting elements is controlled by a control signal 34 for light-emitting elements. In the case of using the timing charts in FIGS. 2A and 2B, the power source control circuit 805 for light-emitting elements controls the potential of the counter electrode of the light-emitting element (counter potential) in such a manner that a reverse driving voltage is applied to the light-emitting element in the writing period Ta while a forward driving voltage is applied to the light-emitting element in the display period Ts. Meanwhile, in the case of using the timing charts in FIGS. 3A and 3B, a counter potential is controlled in such a manner that a driving voltage of 0 V is applied to the light-emitting element in the writing period Ta, a forward driving voltage is applied to the light-emitting element in the display period Ts, and a reverse driving voltage is applied to the light-emitting element in the reverse bias period BF.

The power source control circuit 806 for driver circuits controls a power source voltage inputted to each driver circuit.

Note that the power source control circuit 806 for driver circuits may have a known configuration.

For example, the aforementioned signal control circuit 601, memory controller 603, CPU 604, memory A 605, memory B 606 and display controller 602 may be formed over the same substrate as the pixels of the display 600; formed using an ISI chip and attached to the substrate of the display 600 with COG of TAB bonding; or formed over a different substrate than the display 600 and connected with an electric wiring.

Embodiment 2

Figure 9:
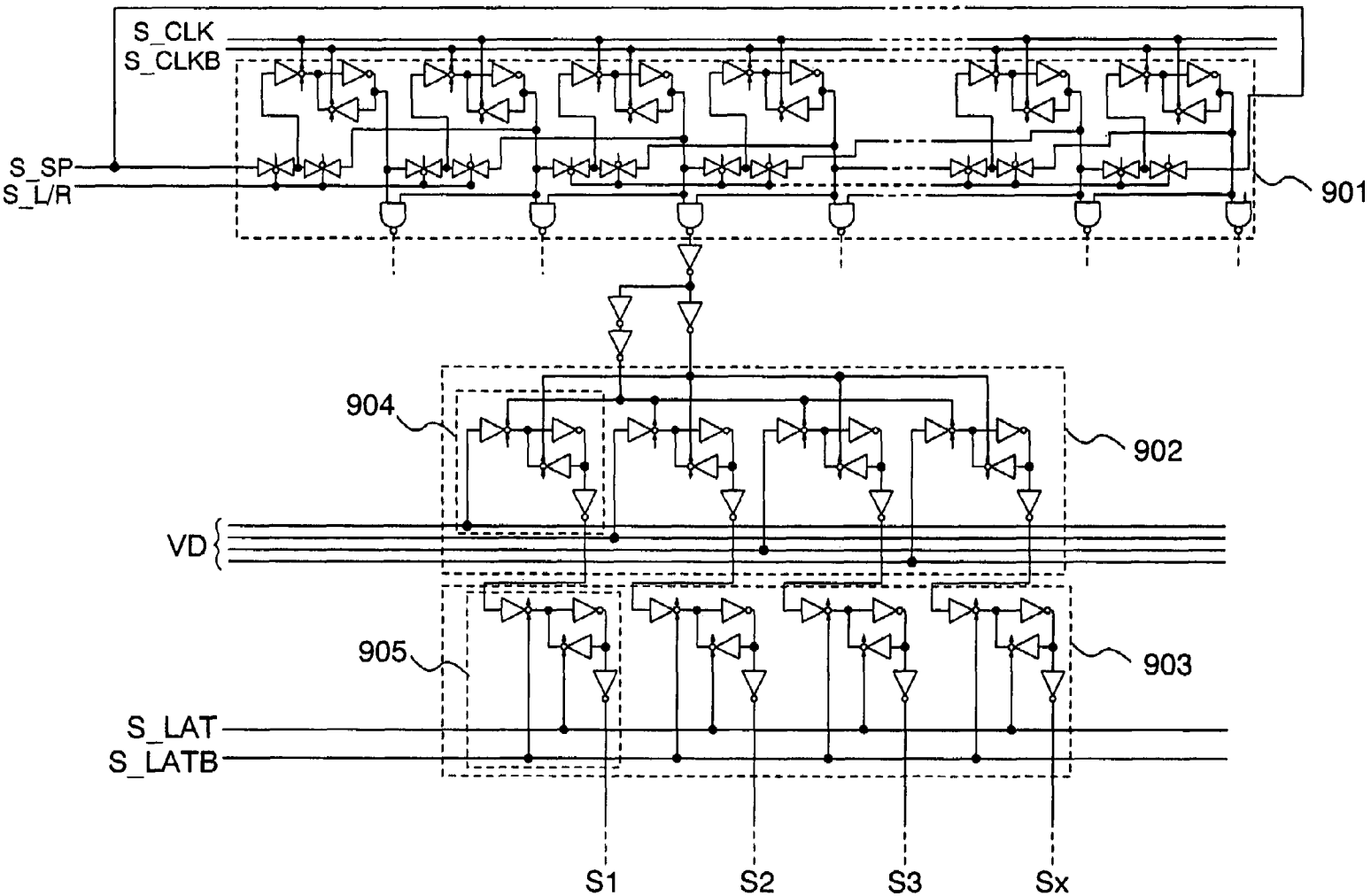
FIG. 9 is a diagram showing a configuration of a source signal line driver circuit used in the display device of the invention (Embodiment 2).

In this embodiment, description is made on a configuration example of a source signal line driver circuit using a digital time gray scale method which is used in the display device of the invention. FIG. 9 shows a configuration example of the source signal line driver circuit.

The source signal line driver circuit includes a shift register 901, a scan direction switching circuit, a LAT (A) 902 and a LAT (B) 903. Note that FIG. 9 partially shows the LAT (A) 902 and the LAT (B) 903 each corresponding to one output of the shift register 901; however, the LAT (A) 902 and the LAT (B) 903 of the same configuration correspond to the whole outputs of the shift register 901.

The shift register 901 includes a clocked inverter, an inverter and a NAND. The shift register 901 is inputted with a start pulse S_SP for a source signal line driver circuit, and on/off of the clocked inverter therein is controlled by a clock pulse S_CLK for the source signal line driver circuit and an inverted clock pulse S_CLKB for the source signal line driver circuit which is obtained by inverting the S_CLK, thereby sampling pulses are sequentially outputted from the NAND to the LAT (A) 902.

The scan direction switching circuit includes a switch, which switches the scan direction of the shift register 901 to the left or right in the drawing. In FIG. 9, in the case where a left/right switching signal L/R corresponds to a Lo signal, the shift register 901 sequentially outputs sampling pulses from left to right in the drawing. On the other hand, in the case where the left/right switching signal L/R corresponds to a Hi signal, the shift register 901 sequentially outputs sampling pulses from right to left in the drawing.

Each stage of the LAT (A) 902 corresponds to a LAT (A) 904 for sampling a video signal to be inputted to one source signal line in this embodiment.

The LAT (A) 904 includes a clocked inverter and an inverter.

Here, a digital video signal VD outputted from the signal control circuit described in Embodiment Mode 1 is divided into p (p is a natural number) signals. That is, signals corresponding to the outputs of p source signal lines are inputted in parallel. When sampling pulses are simultaneously inputted to the clocked inverters of the p LATs (A) 904 through buffers, the p divided input signals are simultaneously sampled by the p LATs (A) 904 respectively.

Here, description is made on an example of a source signal line driver circuit for outputting signal voltages to x source signal lines; therefore, x/p sampling pulses are sequentially outputted from the shift register per horizontal period. In accordance with each sampling pulse, the p LATs (A) 904 simultaneously sample digital video signals correspondingly to the outputs of the p source signal lines.

In this embodiment, the aforementioned method for dividing a digital video signal inputted to the source signal line driver circuit into p-phase parallel signals, and sampling the p digital video signals simultaneously using one sampling pulse is called a p-division drive. FIG. 9 shows a 4-division drive.

According to such a division drive, an enough margin is secured for sampling of the shift register of the source signal line driver circuit. In this manner, the reliability of the display device can be improved.

Upon input of signals for one horizontal period to all the LATs (A) 904, a latch pulse S_LAT and an inverted latch pulse S_LATB which is obtained by inverting the S-LAT are inputted thereto, and signals inputted to the LATs (A) 904 are outputted to the respective stages of the LAT (B) 903 all at once.

Note that each stage of the LAT (B) 903 corresponds to a LAT (B) 905 to which a signal from each stage of the LAT (A) 902 is inputted.

Each LAT (B) 905 includes a clocked inverted and an inverter. A signal outputted from each LAT (A) 904 is held in the LAT (B) 905, and at the same time, outputted to each of the source signal lines S1 to Sx.

Note that a level shifter, a buffer and the like may be appropriately provided though not shown.

A start pulse S_SP, a clock pulse S_CLK and the like inputted to the shift register 901, the LAT (A) 902 and the LAT (B) 903 are inputted from the display controller shown in Embodiment 1 of the invention.

In this embodiment, the operation of inputting a digital video signal to the LAT (A) of the source signal line driver circuit is controlled by the signal control circuit while a clock pulse S_CLK and a start pulse S_SP inputted to the shift register of the source signal line driver circuit, and the operation of inputting a driving voltage for operating the source signal line driver circuit are controlled by the display controller.

Note that the display device of the invention is not limited to have the configuration of the source signal line driver circuit in this embodiment, and a source signal line driver circuit having a known configuration may be employed freely.

In addition, depending on the configuration of the source signal line driver circuit, the number of the signal lines inputted to the source signal line driver circuit from the display controller and the number of the power source lines of the driving voltage vary.

This embodiment can be freely implemented in combination with the aforementioned embodiment modes and embodiment.

Embodiment 3

Figure 10:
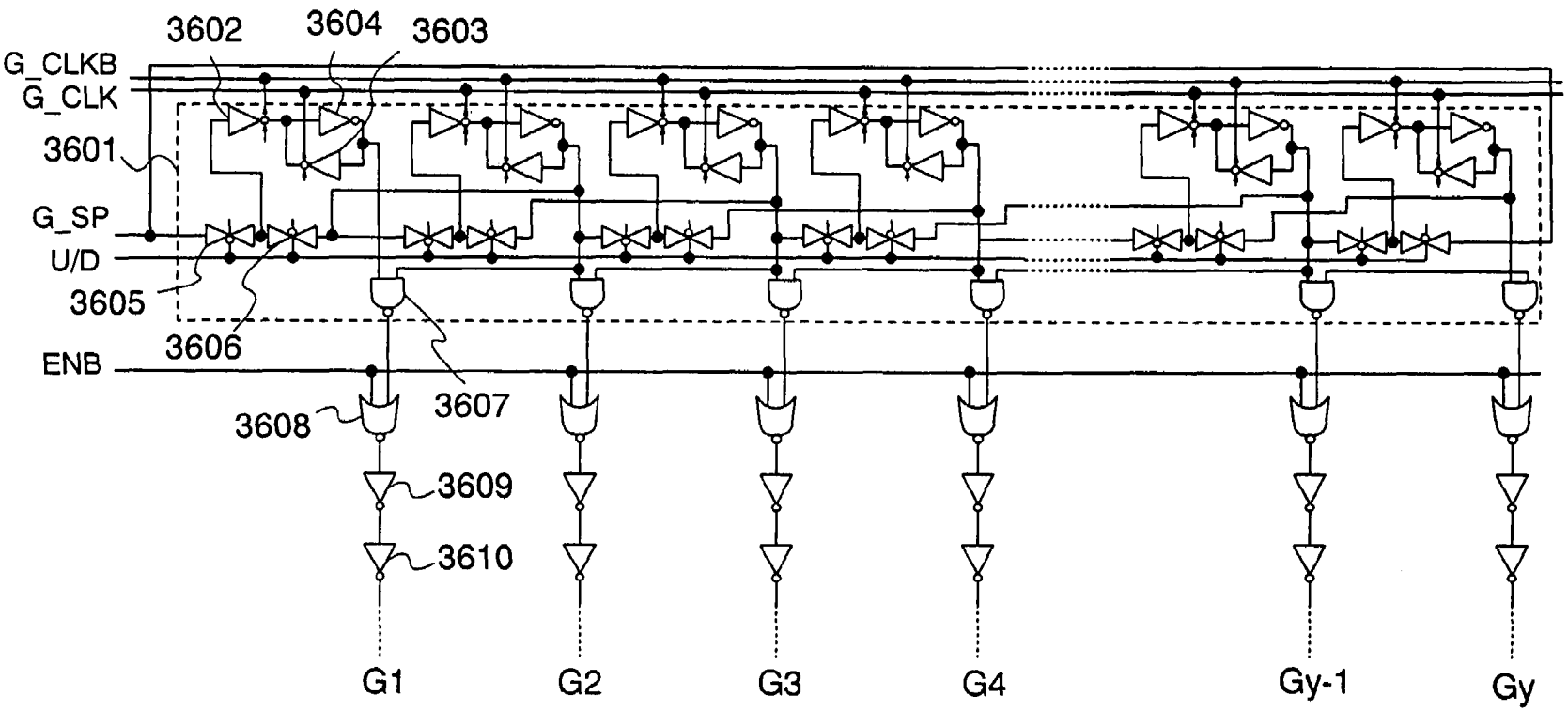
FIG. 10 is a diagram showing a configuration of a gate signal line driver circuit used in the display device of the invention (Embodiment 3).

In this embodiment, description is made with reference to FIG. 10 on a configuration example of a gate signal line driver circuit used in the display device of the invention.

The gate signal line driver circuit includes a shift register, a scan direction switching circuit and the like. Note that a level shifter, a buffer and the like may be appropriately provided though not shown.

The shift register is inputted with a start pulse G_SP, a clock pulse G_CLK, a driving voltage and the like, and outputs a gate signal line selection signal.

A shift register 3601 includes clocked inverters 3602 and 3603, an inverter 3604 and a NAND 3607. The shift register 3601 is inputted with a start pulse G_SP, and on/off of the clocked inverters 3602 and 3603 therein are controlled by a clock pulse G_CLK and an inverted clock pulse G_CLKB which is obtained by inverting the G_CLK, thereby sampling pulses are sequentially outputted from the NAND 3607.

A scan direction switching circuit includes switches 3605 and 3606, which switches the scan direction of the shift register 3601 to the left or right in the drawing. In FIG. 10, in the case where a scan direction switching signal U/D corresponds to a Lo signal, the shift register 3601 sequentially outputs sampling pulses from left to right in the drawing. On the other hand, in the case where the scan direction switching signal U/D corresponds to a Hi signal, the shift register sequentially outputs sampling pulses from right to left in the drawing.

The sampling pulse outputted from the shift register 3601 is inputted to a NOR 3608, and operated with an enable signal ENB. This operation is carried out in order to prevent the adjacent gate signal lines from being selected simultaneously due to a rounded sampling pulse. The signal outputted from the NOR 3608 is outputted to the gate signal lines G1 to Gy though buffers 3609 and 3610.

Note that a level shifter, a buffer and the like may be appropriately provided though not shown.

The start pulse G_SP, the clock pulse G_CLK, the driving voltage and the like which are inputted to the shift register 3601 are inputted from the display controller shown in Embodiment Mode 1 of this specification.

The display device of the invention is not limited to have the configuration of the gate signal line driver circuit in this embodiment, and a gate signal line driver circuit having a known configuration may be employed freely.

In addition, depending on the configuration of the gate signal line driver circuit, the number of the signal lines inputted to the gate signal line driver circuit from the display controller and the number of the power source lines of the driving voltage vary.

This embodiment can be freely implemented in combination with the aforementioned embodiment modes and embodiments.

Embodiment 4

Description is made with reference to FIGS. 11A to 13 on a display mounted with a pixel portion and a driver circuit which is one mode of the display device of the invention.

Figure 11A:
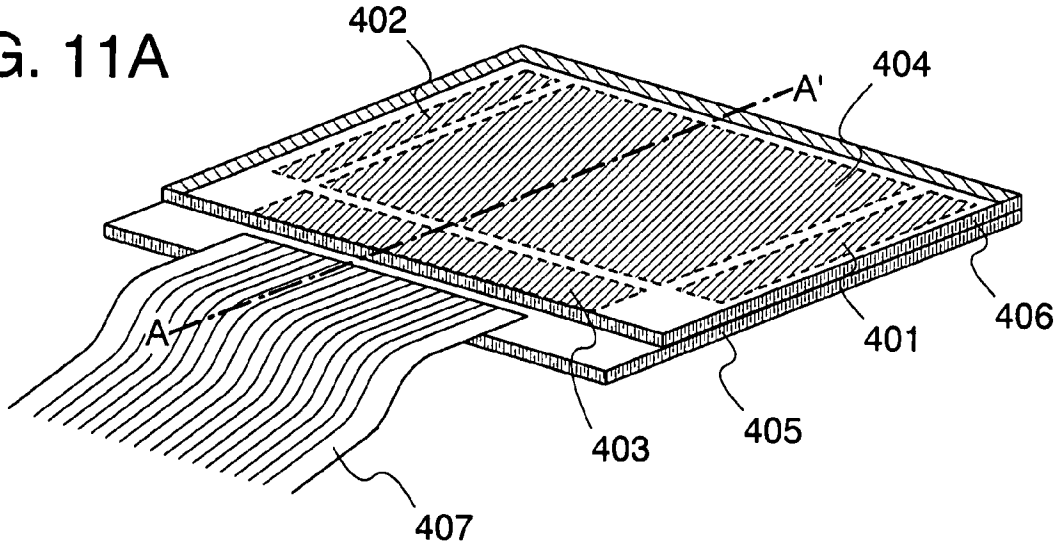
FIG. 11A is a perspective view of the display device of the invention and FIG. 11B is a cross-sectional view thereof (Embodiment 4).

In FIG. 11A, a pixel portion 404 having a plurality of pixels each including a light-emitting element, a source signal line driver circuit 403, first and second gate signal line driver circuits 401 and 402, a connection terminal 415 and a connection film 407 are provided over a substrate 405. The connection terminal 415 is connected to the connection film 407 through an anisotropic conductive particle and the like. The connection film 407 is connected to an IC chip.

Figure 11B:
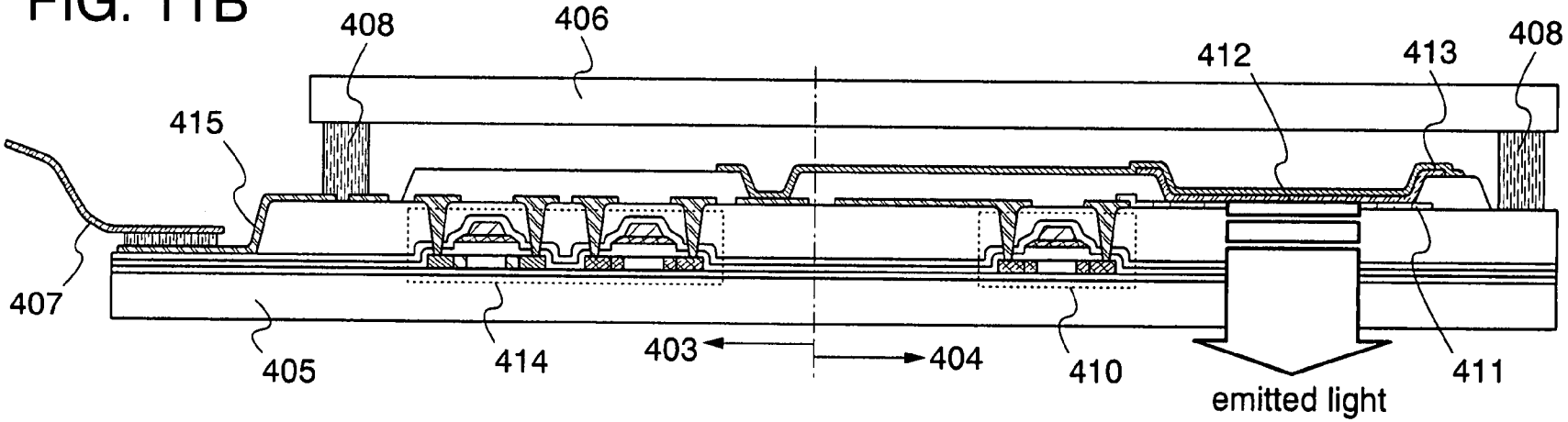

FIG. 11B is a cross-sectional view along a line A-A' of the panel in FIG. 11A, which includes a driving transistor 410 provided in the pixel portion 404 and a CMOS circuit 414 provided in the source signal line driver circuit 403. In addition, FIG. 11B shows a conductive layer 411 provided in the pixel portion 404, an electroluminescent layer 412 and a conductive layer 413. The conductive layer 411 is connected to a source electrode or a drain electrode of the driving transistor 410. The conductive layer 411 functions as a pixel electrode while the conductive layer 413 functions as a counter electrode. A stack of the conductive layer 411, the electroluminescent layer 412 and the conductive layer 413 corresponds to a light-emitting element.

A sealant 408 is provided around the pixel portion 404 and the driver circuits 401 to 403, and light-emitting elements are sealed by the sealant 408 and a counter substrate 406. This sealing process is carried out for protecting the light-emitting elements from moisture, and sealing is performed here by using a covering material (glass, ceramics, plastic, metal and the like). Alternatively, sealing may be performed by using a heat curable resin or an ultraviolet curable resin, or by using a thin film having a high barrier property such as a metal oxide film or a metal nitride film.

Elements formed over the substrate 405 are preferably formed of crystalline semiconductors (polysilicon) having excellent properties such as mobility as compared to amorphous semiconductors, which enables monolithic integration over the same surface. According to a panel having the aforementioned structure, the number of ICs to be connected externally can be reduced, which realizes downsizing, weight saving and thinner shape.

In addition, the conductive layer 411 in FIG. 11B is formed of a light-transmissive film while the conductive layer 413 is formed of a reflective film. Accordingly, light emitted from the electroluminescent layer 412 is emitted in the direction of the substrate 405 through the conductive layer 411 as shown by an arrow. In general, such a structure is called a bottom-emission structure.

Figure 12A:
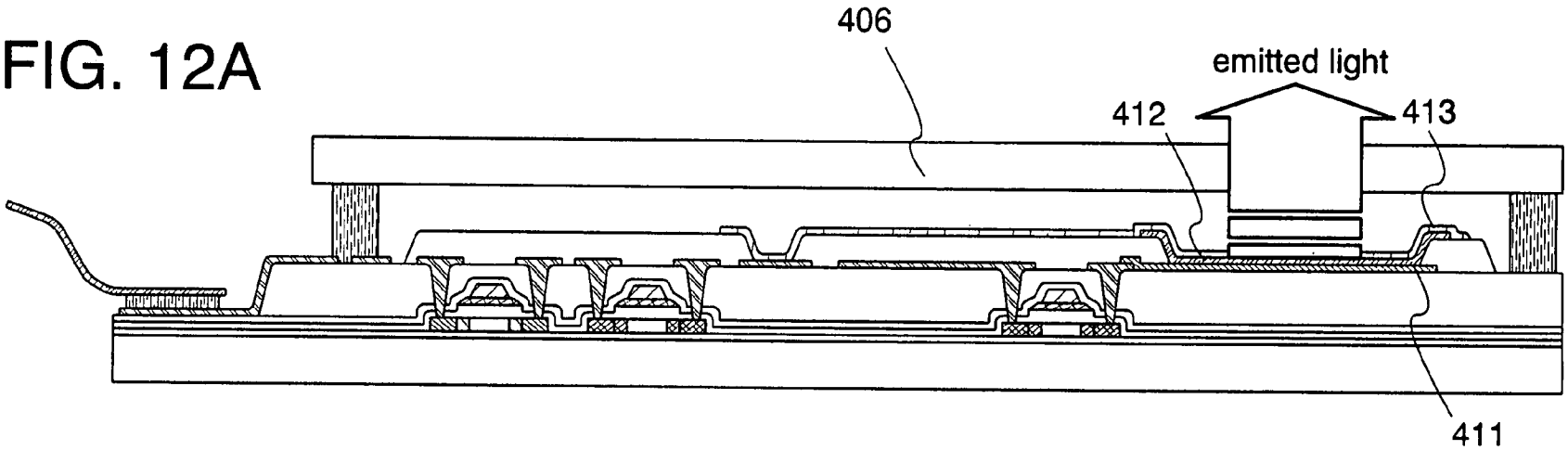
FIGS. 12A and 12B are cross-sectional views of the display device of the invention (Embodiment 4).

On the contrary, by forming the conductive layer 411 using a reflecting film while forming the conductive layer 413 using a light-transmissive film, a structure as shown in FIG. 12A can be realized in which light emitted from the electroluminescent layer 412 is emitted in the direction of the counter substrate 406. In general, such a structure is called a top-emission structure.

Figure 12B:
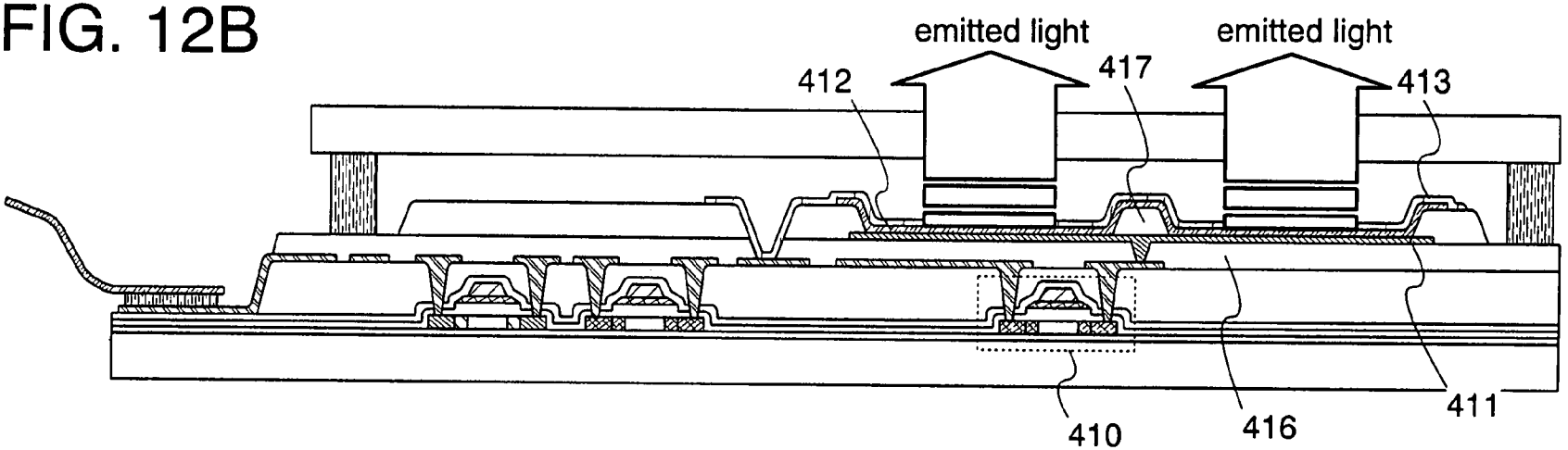

The source electrode or the drain electrode of the driving transistor 401 and the conductive layer 411 are stacked in the same layer without interposing an insulating film therebetween, and therefore connected directly by overlapping each other. Thus, the formation region of the conductive layer 411 corresponds to the region where the driving transistor 410 and the like are not formed. Thus, decrease in the aperture ratio along with the increase in resolution cannot be avoided. Accordingly, by adding an interlayer film and providing a pixel electrode over the interlayer film to obtain a top-emission structure as shown in FIG. 12B, the region in which transistors and the like are formed can be effectively used as a light-emitting region. At this time, there is a possibility that the conductive layer 411 and the conductive layer 413 are short-circuited in the contact region between the conductive layer 411 functioning as a pixel electrode and the source electrode or the drain electrode of the driving transistor 410 depending on the thickness of the electroluminescent layer 412. Therefore, a bank 417 or the like is desirably formed so as to prevent a short circuit.

Figure 13:
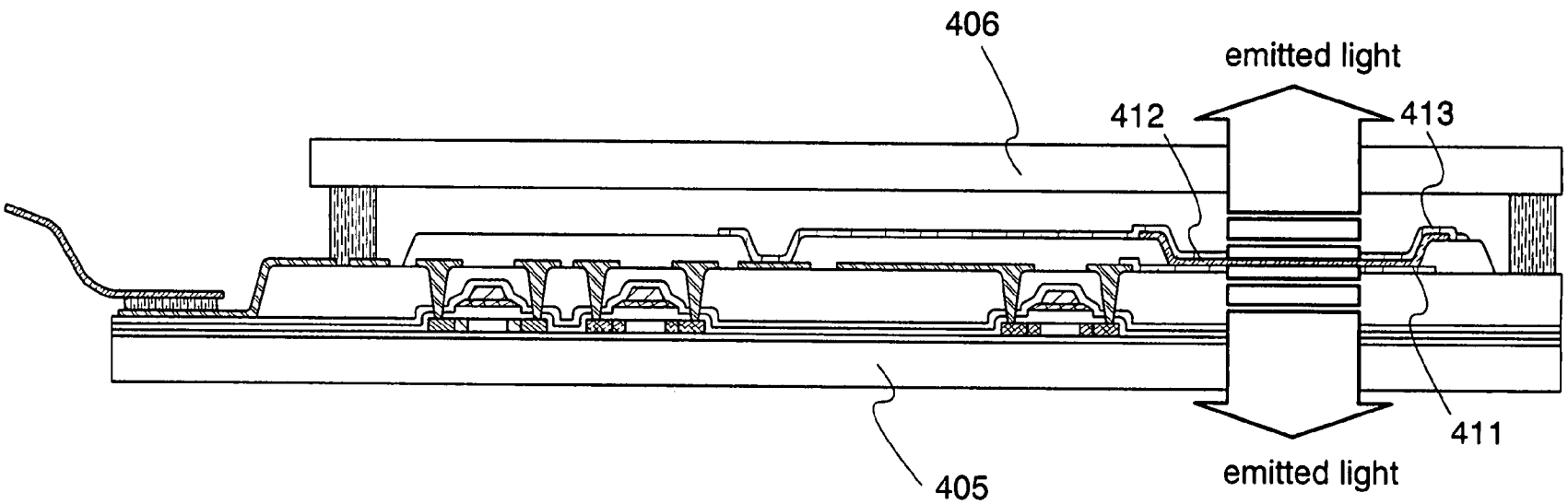
FIG. 13 is a cross-sectional view of the display device of the invention (Embodiment 4).

Further, by forming each of the conductive layer 411 and the conductive layer 413 by using a light-transmissive film as shown in FIG. 13, light emitted from the electroluminescent layer 412 can be extracted in both directions of the substrate 405 and the counter substrate 406. Such a structure is called a dual-emission structure.

In the case of FIG. 13, light-emitting areas of the top-emission side and the bottom-emission side are roughly equal; however, it is needless to mention that the aperture ratio of the top-emission side can be increased if an interlayer film is added to increase the area of the pixel electrode as set forth above.

Note that the invention is not limited to the aforementioned embodiment. For example, such a structure may be employed that the pixel portion 404 is constituted by transistors which use amorphous semiconductors (amorphous silicon) formed over an insulating surface as the channel portions thereof while the driver circuits 401 to 403 may be constituted by IC chips. The IC chips may be attached to the substrate by COG bonding or attached to a connection film to be connected to the substrate. The amorphous semiconductors can be formed over a large-area substrate by adopting CVD and does not require a crystallization step; therefore, an inexpensive panel can be provided. At this time, if a droplet discharge method typified by ink-jet deposition is used to form a conductive layer, an even more inexpensive panel can be provided. This embodiment can be freely implemented in combination with the aforementioned embodiment modes and embodiments.

Embodiment 5

Figure 14:
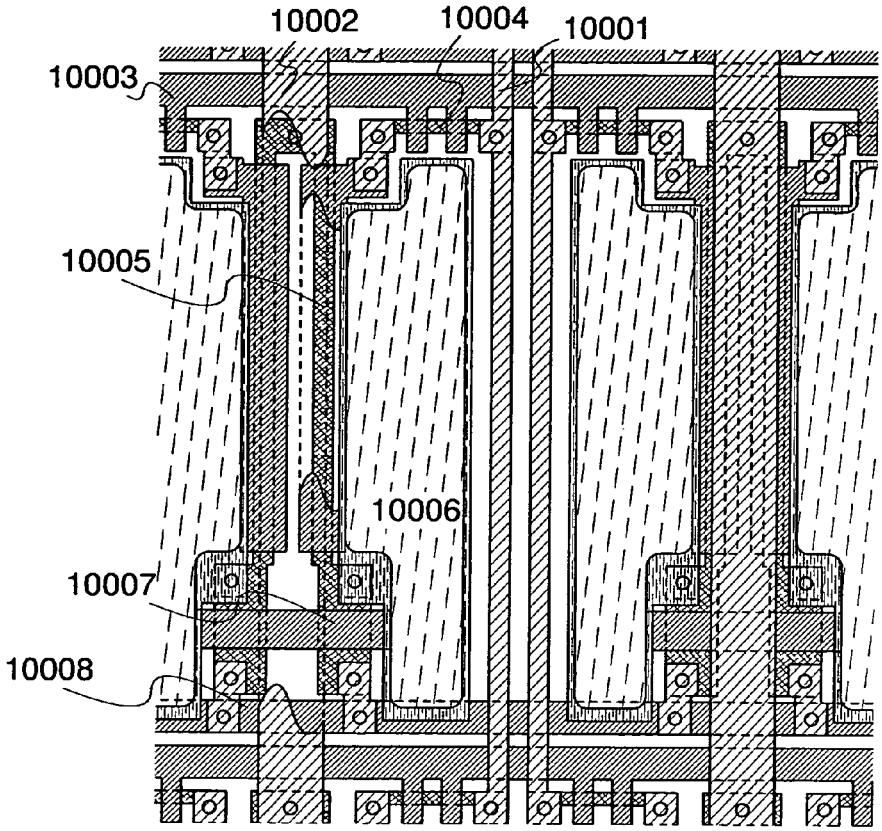
FIG. 14 is a layout of the pixel of the invention (Embodiment 5).

FIG. 14 shows a layout of the circuit configuration of FIG. 1 as one embodiment of the invention.

FIG. 14 includes a source signal line 10001, a power source line 10002, a gate signal line 10003, a switching transistor 10004, a driving transistor 10005, a pixel electrode 10006, an AC transistor 10007 and a current lead-in line 10008. Those having the same name as those in FIG. 1 correspond to each other.

Note that the display device of the invention is not limited to have the layout structure of this embodiment.

This embodiment can be freely implemented in combination with the aforementioned embodiment modes and embodiments.

Embodiment 6

A light-emitting device using light-emitting elements is self light-emitting type; therefore, high visibility is provided in bright place as well as a wide viewing angle is provided. Thus, various electronic appliances can be completed by using the light-emitting device of the invention.

An electronic appliance manufactured by using the light-emitting device in accordance with the invention includes a camera such as a video camera and a digital camera, a goggle type display (a head mounted display), a navigation system, an audio reproducing device (e.g., a car audio or an audio component stereo), a laptop personal computer, a game machine, a portable information terminal (e.g., a mobile computer, a portable phone, a portable game machine or an electronic book), an image reproducing device provided with a recording medium (specifically, a device for reproducing a recording medium such as a digital versatile disk (DVD) and having a display device for displaying the reproduced image) and the like. In particular, as for the portable information terminal having a display screen which is often seen obliquely, the viewing angle is desirably wide, thus a light-emitting device having light-emitting elements is preferably employed. FIGS. 15A to 15H illustrate specific examples of such electronic appliances.

Figure 15A:
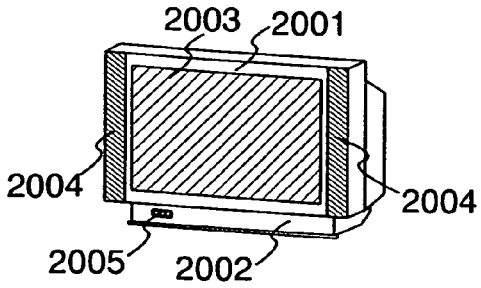
FIGS. 15A to 15H are views of electronic appliances to which the display device of the invention is applied (Embodiment 6).

FIG. 15A is a display device which includes a housing 2001, a support base 2002, a display portion 2003, speaker portions 2004, a video input terminal 2005 and the like. The light-emitting device in accordance with the invention can be applied to the display portion 2003 to manufacture the display device. A light-emitting device having light-emitting elements is a self light-emitting type; therefore, no backlight is required and a thinner display portion than a liquid crystal display can be provided. Note that the display device includes all information display devices for personal computers, TV broadcast reception and advertisement.

Figure 15B:
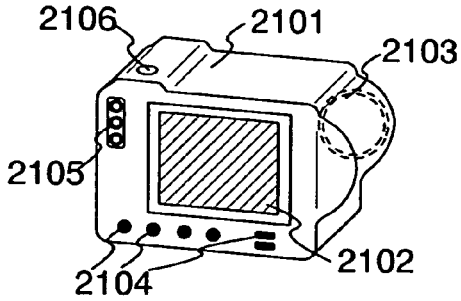

FIG. 15B is a digital still camera which includes a main body 2101, a display portion 2102, an image receiving portion 2103, operating keys 2104, an external connection port 2105, a shutter 2106 and the like. The light-emitting device in accordance with the invention can be applied to the display portion 2102 to manufacture the digital still camera.

Figure 15C:
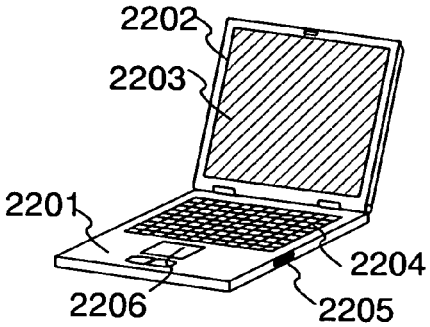

FIG. 15C is a laptop personal computer which includes a main body 2201, a housing 2202, a display portion 2203, a keyboard 2204, an external connection port 2205, a pointing mouse 2206 and the like. The light-emitting device in accordance with the invention can be applied to the display portion 2203 to manufacture the laptop personal computer.

Figure 15D:
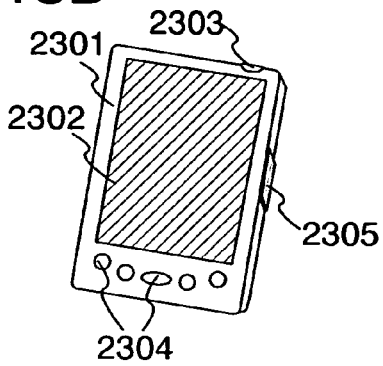

FIG. 15D is a mobile computer which includes a main body 2301, a display portion 2302, a switch 2303, operating keys 2304, an IR port 2305 and the like. The light-emitting device in accordance with the invention can be applied to the display portion 2302 to manufacture the mobile computer.

Figure 15E:
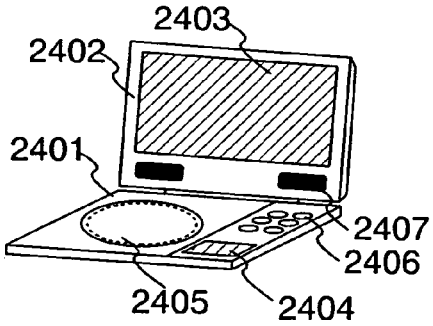

FIG. 15E is a portable image reproducing device provided with a recording medium (specifically, a DVD reproducing device) which includes a main body 2401, a housing 2402, a display portion A 2403, a display portion B 2404, a recording medium (e.g., DVD) reading portion 2405, an operating key 2406, a speaker portion 2407 and the like. The display portion A 2403 mainly displays image data while the display portion B 2404 mainly displays text data. The light-emitting device in accordance with the invention can be applied to the display portions A 2403 and B 2404 to manufacture the portable image reproducing device. Note that the image reproducing device provided with a recording medium includes a home game machine and the like.

Figure 15F:
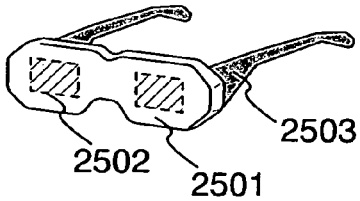

FIG. 15F is a goggle type display (head mounted display) which includes a main body 2501, a display portion 2502, an arm portion 2503 and the like. The light-emitting device in accordance with the invention can be applied to the display portion 2502 to manufacture the goggle type display.

Figure 15G:
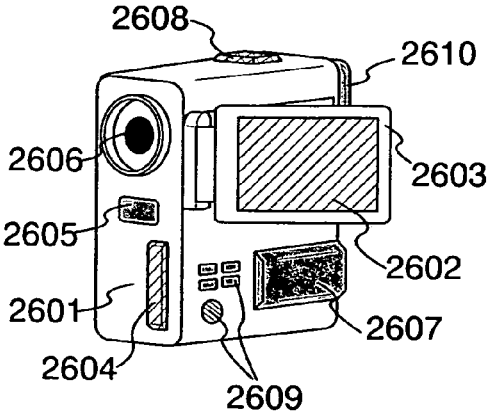

FIG. 15G is a video camera which includes a main body 2601, a display portion 2602, a housing 2603, an external connection port 2604, a remote controller receiving portion 2605, an image receiving portion 2606, a battery 2607, an audio input portion 2608, operating keys 2609, an eyepiece portion 2610 and the like. The light-emitting device in accordance with the invention can be applied to the display portion 2602 to manufacture the video camera.

Figure 15H:
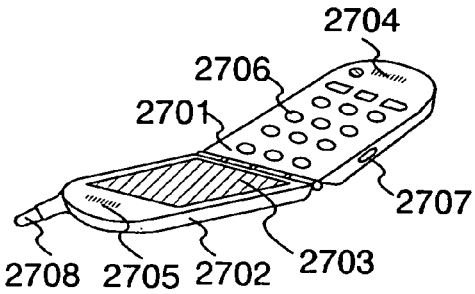
Figure 16:
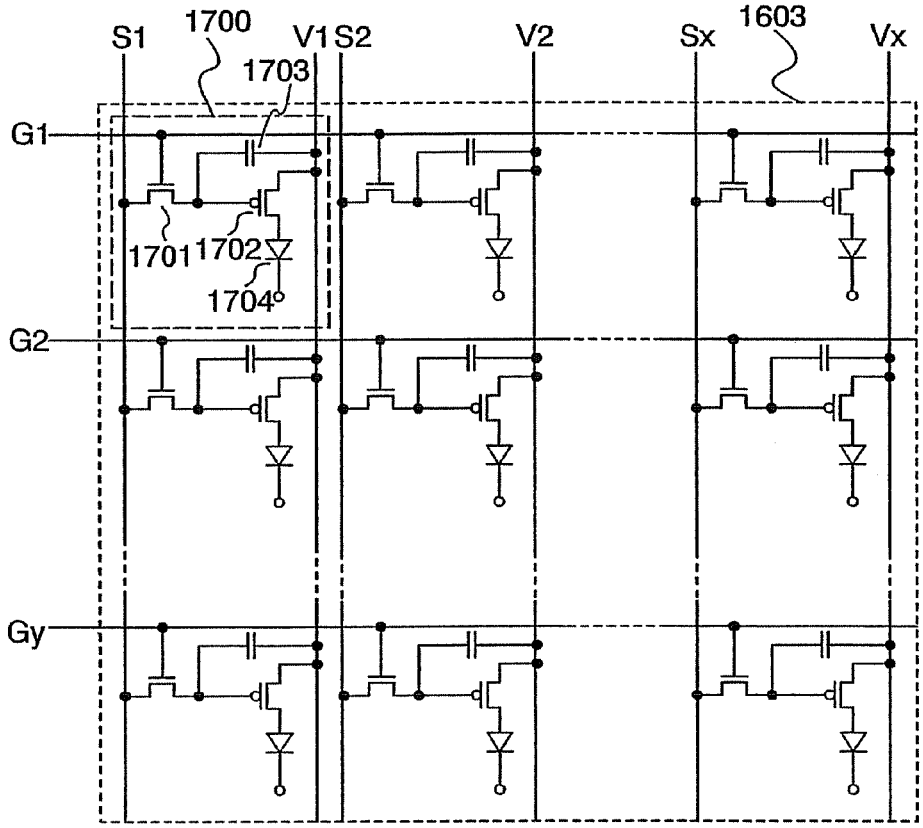
FIG. 16 PRIOR ART
FIG. 16 is a diagram showing a configuration of a pixel portion of a conventional display.

FIG. 15H is a portable phone which includes a main body 2701, a housing 2702, a display portion 2703, an audio input portion 2704, an audio output portion 2705, an operating key 2706, an external connection port 2707, an antenna 2708 and the like. The light-emitting device in accordance with the invention can be applied to the display portion 2703 to manufacture the portable phone. Note that the power consumption of the portable phone can be suppressed by displaying white text on the black background of the display portion 2703.

Note that if the higher luminance of an organic material becomes available in future, the invention can be applied to a front or rear projector by projecting the light containing the output image data through magnification with a lens and the like.

The aforementioned electronic appliances are now becoming to be used more often for displaying data distributed through telecommunication paths such as the Internet and CATV (cable television), particularly for displaying moving image data. The response speed of the organic material is quite high; therefore, the light-emitting device is suitable for displaying moving images.

In addition, since the light-emitting device consumes power in its light-emitting portion, data is preferably displayed with as small a light-emitting area as possible. Thus, in the case where the light-emitting device is used in a display portion of a portable information terminal, in particular such as a portable phone and an audio reproducing device which mainly display text data, the text data is preferably displayed with a light-emitting portion utilizing the non-light-emitting portion as a background.

This embodiment can be freely implemented in combination with Embodiments 1 to 5.

The present application is based on Japanese Priority application No. 2004-247735 filed on Aug. 27, 2004 with the Japanese Patent Office, the entire contents of which are hereby incorporated by reference.

What is claimed is:

1. A display device comprising:

a pixel comprising:

a light-emitting element;

a driving transistor;

an AC transistor;

a first path for supplying a forward current to the light-emitting element; and a second path for supplying a reverse current to the light-emitting element, wherein the light-emitting element comprises a pixel electrode and an opposing electrode, wherein one of a source electrode and a drain electrode of the driving transistor is connected to the pixel electrode of the light-emitting element, wherein one of a source electrode and a drain electrode of the AC transistor is connected to the pixel electrode of the light-emitting element, wherein the driving transistor is disposed in the first path and the AC transistor is disposed in the second path, wherein switching between the first path and the second path is controlled by using the driving transistor and the AC transistor, and wherein the AC transistor is stopped after the display device is mounted on an electronic appliance.

2. The display device according to claim 1, wherein the driving transistor and the AC transistor have the same conductivity type, wherein the driving transistor operates in a saturation region, and wherein the AC transistor operates in a linear region.

3. The display device according to claim 1, wherein the ratio of a channel length of the driving transistor to a channel width thereof is 5 or more to 1.

4. The display device according to claim 1, wherein a channel length of the AC transistor is equal or shorter than a channel width thereof.

5. The display device according to claim 1, wherein the pixel is arranged in matrix.

6. The display device according to claim 1, wherein the electronic appliance is selected from the group consisting of a camera such as a video camera and a digital camera, a goggle type display, a navigation system, an audio reproducing device, a laptop personal computer, a game machine, a mobile computer, a portable phone, a portable game machine, an electronic book, and an image reproducing device provided with a recording medium.

7. A display device comprising:

a pixel comprising:

a light-emitting element;

a driving transistor for controlling the amount of a forward current flowing to the light-emitting element;

a switching transistor for controlling input of a video signal; and an AC transistor for controlling a reverse current flowing to the light-emitting element, wherein the light-emitting element comprises a pixel electrode and an opposing electrode, wherein one of a source electrode and a drain electrode of the driving transistor is connected to the pixel electrode of the light-emitting element, wherein one of a source electrode and a drain electrode of the AC transistor is connected to the pixel electrode of the light-emitting element, and wherein the AC transistor is stopped after the display device is mounted on an electronic appliance.

8. The display device according to claim 7,
wherein the driving transistor and the AC transistor have the same conductivity type,
wherein the driving transistor operates in a saturation region, and
wherein the AC transistor operates in a linear region.

9. The display device according to claim 7, wherein the ratio of a channel length of the driving transistor to a channel width thereof is 5 or more to 1.

10. The display device according to claim 7, wherein a channel length of the AC transistor is equal or shorter than a channel width thereof.

11. The display device according to claim 7, wherein the pixel is arranged in matrix.

12. The display device according to claim 7, wherein the electronic appliance is selected from the group consisting of a camera such as a video camera and a digital camera, a goggle type display, a navigation system, an audio reproducing device, a laptop personal computer, a game machine, a mobile computer, a portable phone, a portable game machine, an electronic book, and an image reproducing device provided with a recording medium.

13. A display device comprising:
a pixel comprising:
a light-emitting element;
a driving transistor for controlling the amount of a forward current flowing to the light-emitting element;
a switching transistor for controlling input of a video signal;
an AC transistor for controlling a reverse current flowing to the light-emitting element;
a gate signal line;
a source signal line;
a power source line; and
a current lead-in line,
wherein the light-emitting element comprises a pixel electrode and an opposing electrode,
wherein one of a source electrode and a drain electrode of the driving transistor is connected to the pixel electrode of the light-emitting element,
wherein one of a source electrode and a drain electrode of the AC transistor is connected to the pixel electrode of the light-emitting element,
wherein a gate electrode of the switching transistor is connected to the gate signal line,
wherein the switching transistor is connected to the source signal line and a gate electrode of the driving transistor,
wherein the driving transistor is connected to the power source line and the light-emitting element,
wherein a gate electrode of the AC transistor is connected to the power source line,
wherein the AC transistor is connected to the light-emitting element and the current lead-in line, and
wherein the AC transistor is stopped after the display device is mounted on an electronic appliance.

14. The display device according to claim 13,
wherein the driving transistor and the AC transistor have the same conductivity type,
wherein the driving transistor operates in a saturation region, and
wherein the AC transistor operates in a linear region.

15. The display device according to claim 13, wherein the ratio of a channel length of the driving transistor to a channel width thereof is 5 or more to 1.

16. The display device according to claim 13, wherein a channel length of the AC transistor is equal or shorter than a channel width thereof.

17. The display device according to claim 13, wherein the pixel is arranged in matrix.

18. The display device according to claim 13, wherein a potential of the power source line is fixed, and a potential of a counter electrode of the light-emitting element is changed according to the direction of a current flowing to the light-emitting element.

19. The display device according to claim 13, wherein the electronic appliance is selected from the group consisting of a camera such as a video camera and a digital camera, a goggle type display, a navigation system, an audio reproducing device, a laptop personal computer, a game machine, a mobile computer, a portable phone, a portable game machine, an electronic book, and an image reproducing device provided with a recording medium.

20. A display device comprising:
a pixel comprising:
a light-emitting element;
a driving transistor for controlling the amount of a forward current flowing to the light-emitting element;
an AC transistor;
a switching transistor for controlling input of a video signal; and
an AC driver circuit for applying an AC signal to the light-emitting element,
wherein the light-emitting element comprises a pixel electrode and an opposing electrode,
wherein one of a source electrode and a drain electrode of the driving transistor is connected to the pixel electrode of the light-emitting element,
wherein one of a source electrode and a drain electrode of the AC transistor is connected to the pixel electrode of the light-emitting element,
wherein the driving transistor operates in the linear region, and
wherein the AC driver circuit is stopped after the display device is mounted on an electronic appliance.

21. The display device according to claim 20, wherein the pixel is arranged in matrix.

22. The display device according to claim 20, wherein the electronic appliance is selected from the group consisting of a camera such as a video camera and a digital camera, a goggle type display, a navigation system, an audio reproducing device, a laptop personal computer, a game machine, a mobile computer, a portable phone, a portable game machine, an electronic book, and an image reproducing device provided with a recording medium.

* * * * *

UNITED STATES PATENT AND TRADEMARK OFFICE

CERTIFICATE OF CORRECTION

PATENT NO. : 7,592,975 B2
APPLICATION NO. : 11/208278
DATED : September 22, 2009
INVENTOR(S) : Yamazaki et al.

It is certified that error appears in the above-identified patent and that said Letters Patent is hereby corrected as shown below:

On the cover page,

[*] Notice: Subject to any disclaimer, the term of this patent is extended or adjusted under 35 USC 154(b) by 609 days.

Delete the phrase "by 609 days" and insert -- by 1009 days --

Signed and Sealed this

Fourth Day of May, 2010

David J. Kappos

David J. Kappos
*Director of the United States Patent and Trademark Office*